US007237528B2

(12) United States Patent
Matsuda

(10) Patent No.: US 7,237,528 B2
(45) Date of Patent: Jul. 3, 2007

(54) THROTTLE VALVE CONTROL DEVICE FOR LEISURE VEHICLE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/090,978

(22) Filed: Mar. 25, 2005

(65) Prior Publication Data

US 2005/0211220 A1 Sep. 29, 2005

(30) Foreign Application Priority Data

Mar. 26, 2004 (JP) ..... 2004-091182
Mar. 26, 2004 (JP) ..... 2004-091714
Apr. 28, 2004 (JP) ..... 2004-133802

(51) Int. Cl.
*F02D 9/08* (2006.01)
*F02D 11/10* (2006.01)

(52) U.S. Cl. ..... 123/336; 123/399

(58) Field of Classification Search ..... 123/336, 123/337, 399, 184.25, 184.35, 184.27, 184.37, 123/184.45, 184.48; 73/118.1
See application file for complete search history.

(56) References Cited

U.S. PATENT DOCUMENTS 4,825,833 A * 5/1989 Ikeura et al. ..... 123/435
5,063,899 A * 11/1991 Hitomi et al. ..... 123/336
5,181,491 A * 1/1993 Izumi et al. ..... 123/336
5,205,244 A * 4/1993 Nakamura et al. ..... 123/58.1
6,422,201 B1 * 7/2002 Yamada et al. ..... 123/336
6,840,096 B2 * 1/2005 Samoto et al. ..... 73/118.1
6,868,828 B2 * 3/2005 Kondo ..... 123/339.26
7,010,955 B2 * 3/2006 Suzuki ..... 73/1.79

FOREIGN PATENT DOCUMENTS

JP 62-162759 7/1987
JP SHO63-39406 10/1988
JP 2002-129987 5/2002

* cited by examiner

*Primary Examiner*—Stephen K. Cronin
*Assistant Examiner*—Johnny H. Hoang
(74) *Attorney, Agent, or Firm*—Alleman Hall McCoy Russell & Tuttle LLP

(57) ABSTRACT

A multi-cylinder engine for driving a vehicle is provided. The multi-cylinder engine includes a plurality of cylinders. The engine also includes a multi-throttle valve device having a plurality of air-intake passages, each of which being configured to lead air to the respective cylinder, and a plurality of throttle valves, each of which being configured to open and close the respective air-intake passage. At least one of the throttle valves is configured to be opened and closed independently of at least one of the other throttle valves.

19 Claims, 16 Drawing Sheets

THROTTLE VALVE CONTROL DEVICE FOR LEISURE VEHICLE

TECHNICAL FIELD

The present invention relates to a throttle valve control device for a multi-cylinder engine mounted on a leisure vehicle, and more particularly, to an electronic control device for a multi-throttle valve of the multi-cylinder engine.

BACKGROUND OF THE INVENTION

There are various types of leisure vehicles equipped with a multi-cylinder engine. Some types of leisure vehicles are, for example, a motorcycle, an all terrain vehicle, and a personal watercraft (PWC). These vehicles are configured so that output power from the engine is transmitted to a propulsion mechanism such as a wheel or a water jet pump to generate a propulsion force of the vehicle. Typically, the engine is equipped with a throttle valve control device. The throttle valve control device is configured to control the output power from the engine by opening/closing a throttle valve of the engine to adjust an intake amount of air supplied to a combustion chamber of the engine.

Japanese Published Unexamined Patent Application SHO62-162759 discloses a multi-cylinder engine equipped with a multi-throttle valve, for a purpose of reducing resistance of intake air to the engine. The multi-throttle valve includes a plurality of throttle valves each of which is provided in respective air-intake passage extending to a combustion chamber of each cylinder. Typically, the multi-throttle valve is of an interlink system or has a structure such that a plurality of throttle valves are rotatably supported by a common valve shaft and, thus, all of the throttle valves are integrally opened and closed to the same degree.

Further, there are several types of driving systems for the throttle valve control. One type of the driving systems is, for example, a system such as disclosed in Japanese Examined Utility Model Application SHO63-39406, in which an operator directly performs an open/close operation of a throttle valve through a cable (also referred to as a cable-driven type). Another type of the driving systems is an electronic control system in which the throttle valve is configured to be driven by an electric motor (also referred to as a motor-driven type). Still another type of the driving system is a combined system of the cable-driven and motor-driven types (also referred to as a double-throttle type).

The double-throttle type has a configuration in which the cable-driven type throttle valve (main valve) and the motor-driven type throttle valve (sub-valve) are arranged on a downstream side and on an upstream side, respectively, in a single air-intake passage. In this configuration, an air-intake amount is coarsely adjusted by the main valve according to a throttle operation by the operator, and the coarsely adjusted air is further fine-adjusted by the electronically-controlled sub-valve so that an optimized amount of the intake air is supplied into the combustion chamber of the engine.

In some cases with a four-cycle engine, as the throttle is gradually opened from a state in which the throttle valve is in a fully-closed state and a negative engine torque is generated, a rate of increase in the engine torque greatly changes with respect to a rate of increase in the throttle opening at a certain amount of the throttle opening. This is undesirable in terms of improving the riding comfort of the operator during the acceleration of the vehicle from an engine idle state.

Further in a multi-cylinder four-cycle engine, such great change in the engine torque may also occur in each cylinder, even if the multi-throttle valve of any of the above conventional driving systems is used. The overall engine torque is a sum of the outputted torques produced by all of the cylinders. Therefore, the above-mentioned change in the engine torque becomes noticeable for the engines with many cylinders, such as four cylinders or six cylinders, and may cause a difficulty in an improvement in the operator's riding comfort.

Typically, such engine torque characteristics are difficult to correct by merely adjusting an injecting amount of fuel to be mixed with the intake air, an injecting timing of the fuel, an ignition timing, and the like.

Meanwhile, in order to obtain a good operating feel of a throttle operating portion, such as a twist grip throttle control (TGTC), during acceleration/deceleration of the vehicle, it is desirable to improve a response of the throttle valve control device, that is, a response of the valve shaft. For this purpose, a configuration in which the electric motor is arranged so that the output shaft of the motor is coaxially aligned with the valve shaft, and the output shaft is directly coupled with one end portion of the valve shaft, is advantageous. However in this case, a dimension of the throttle valve control device in the valve shaft direction becomes large.

Further in order to improve the response of the throttle valve control device, a response of the motor against an input signal to the motor may be improved. This improvement may be achieved by reducing a radial dimension of the motor so as to reduce a moment of inertia of a rotor of the motor around the output shaft. However, in order to ensure a certain amount of torque from the motor, if the radial dimension is reduced, an axial dimension has to be increased instead. Accordingly, in the configuration in which the valve shaft and the output shaft are directly coupled to each other as described above, the dimension of the throttle valve control device in the valve shaft direction may further increase.

This consequently makes it difficult to mount the engine equipped with such a throttle valve control device especially on a vehicle with a relatively narrow engine mounting space, such as a motorcycle, an all terrain vehicle (ATV), and a personal watercraft (PWC), and this is undesirable.

For example, if the throttle valve control device is applied to a motorcycle equipped with an inline multi-cylinder engine, the throttle valve control device may be arranged so that the valve shaft is directed toward the width direction of the motorcycle. Accordingly, if the size of the throttle valve control device is increased, the size of the motorcycle needs to be increased in the width direction thereof. This size increase is undesirable if the riding comfort of the operator who rides on the motorcycle gripping a body of the motorcycle with his/her knees is taken into consideration.

Instead, the electric motor may be coupled with the valve shaft through a gear train including a bevel gear and the like to avoid the increase in the size of the throttle valve control device in the width direction of the vehicle. However, this configuration maynot aid in the improvement of the response of the throttle valve control device because the gear train is relatively large in mass and, thus, has a large moment of inertia.

Meanwhile, when the operator (rider) makes a turn (especially, a tight turn) on a motorcycle, the operator closes the throttle to decelerate the motorcycle before entering the corner and, then, opens the throttle to accelerate the motorcycle as approaching the end of the corner. In this case, when entering the corner, the operator must keep the throttle closed for a while and, then, the operator must open the throttle so as to match the throttle-opening operation accurately with a speed of the motorcycle.

If the motorcycle is equipped with the motor-driven throttle valve, the electric motor is configured to actuate the throttle valve directly based on the detection value from a throttle positioning sensor. Therefore, a timing of the throttle-opening operation and an amount thereof by the operator that matches the speed of the motorcycle must be accurately performed at all times.

BRIEF SUMMARY OF THE INVENTION

The present invention addresses the above-described conditions, and provides an improved electronic control device for a multi-throttle valve, and a leisure vehicle equipped with the control device.

In one aspect of the invention, a multi-cylinder engine for driving a vehicle includes a plurality of cylinders, and a multi-throttle valve device including a plurality of air-intake passages, each of which is configured to lead air to the respective cylinder, and a plurality of throttle valves, each of which is configured to open and close the respective air-intake passage. At least one of the throttle valves is configured to be opened and closed independently of at least one of the other throttle valves.

The at least one of the throttle valves may be a cable-driven throttle valve which is cooperably coupled with a rider-operating throttle operating portion through a cable. The at least one of the other throttle valves may be a motor-driven throttle valve which is configured to be driven by a motor based on a control signal being given.

The motor may be arranged so that an output shaft thereof is parallel to a valve shaft which rotatably supports the motor-driven throttle valve. The output shaft and the valve shaft may be cooperably coupled through a power transmitting mechanism.

The motor-driven throttle valve may be configured so that a throttle opening thereof is controlled to follow a throttle opening of the cable-driven throttle valve with a predetermined delay.

The multi-cylinder engine may be of four or more cylinders, and the cable-driven throttle valve may be provided to two or more cylinders among these cylinders. Each cylinder provided with a cable-driven throttle valve may be configured to perform combustion successively with respect to the adjacent cylinder.

The multi-throttle valve device may include a first throttle valve positioning sensor configured to detect a throttle opening of the cable-driven throttle valve. The control signal for the motor-driven throttle valve may correspond to a detection value of the first throttle valve positioning sensor.

The multi-throttle valve device may further include a second throttle valve positioning sensor configured to detect a throttle opening of the motor-driven throttle valve.

Two or more of the cable-driven throttle valves may be provided to the cylinders which are adjacently arranged.

In another aspect of the invention, a leisure vehicle includes a multi-cylinder engine for driving the vehicle. The multi-cylinder engine includes a plurality of cylinders, and a multi-throttle valve device having a plurality of air-intake passages, each of which is configured to lead air to a respective cylinder, and a plurality of throttle valves, each of which is configured to open and close the respective air-intake passage. At least one of the throttle valves is configured to be opened and closed independently of at least one of the other throttle valves.

The leisure vehicle may be a motorcycle including a battery. The multi-throttle valve device may include a motor-driven throttle valve. The motor-driven throttle valve may be configured to be driven by a motor which operates by electric power supply from the battery.

The leisure vehicle may further include a throttle operating portion configured to be operable by a rider. The at least one of the throttle valves may be a cable-driven throttle valve configured to be interlocked with the throttle operating portion. The at least one of the other throttle valves may be a motor-driven throttle valve which is configured to be driven by a motor based on a control signal being given.

The leisure vehicle may further include a throttle operating grip configured to be operable by an operator, and a throttle positioning sensor configured to detect an amount of operation of the throttle operating grip. The throttle positioning sensor may be provided with a dead band with a predetermined range from a zero detection position thereof. The throttle positioning sensor may be configured to output a zero value as a detection value within the dead band.

The at least one of the throttle valves may be configured so as not to be operated when a detection value of the throttle positioning sensor is within a predetermined range from a zero detection position.

The leisure vehicle may further include an intermediate mechanism coupled with the throttle operating portion through a wire, and configured to reproduce an operation of the throttle operating portion. The reproduction of the operation may include a slack corresponding to a predetermined range of the operation of the throttle operating portion in the vicinity of a zero position of operation of the throttle operating grip. A throttle positioning sensor configured to detect the reproduced operation of the intermediate mechanism may be provided to the intermediate mechanism.

At least a portion of the intermediate mechanism may be a pulley configured to be rotatable around a rotational shaft and the throttle positioning sensor may be provided to the rotational shaft.

In still another aspect of the invention, a throttle valve control device includes a first throttle-valve set configured to open and close air-intake passage(s) to one or more cylinders of a multi-cylinder engine, a second throttle-valve set configured to open and close air-intake passage(s) to other one or more cylinders of the multi-cylinder engine, a first throttle valve positioning sensor configured to detect a throttle opening of the first throttle-valve set, and a valve controller configured to adjust the throttle opening of the first throttle-valve set according to the amount of throttle work by an operator, and to adjust the throttle opening of the second throttle-valve set based on the throttle opening of the first throttle-valve set detected by the first throttle valve positioning sensor.

The multi-cylinder engine may be of four or more cylinders. The first throttle-valve set may include a plurality of throttle valves in the cylinders which are configured to perform combustions successively with respect to the adjacent cylinder.

At least one of the first and second throttle-valve sets may be configured so that the plurality of throttle valves in the throttle-valve set are coupled together with a common valve shaft.

The common valve shaft of the at least one of the first and second throttle-valve sets may be coupled with an output shaft of a motor through a power transmitting mechanism so that the throttle-valve set is driven by the motor through the power transmitting mechanism. The valve shaft and the output shaft may be configured to be parallel with each other. The valve controller may be configured to adjust the throttle opening by controlling a rotation of the motor.

The power transmitting mechanism may be a belt-pulley mechanism.

The throttle positioning sensor may be configured to detect the amount of throttle work by detecting an amount of operation of a twist grip throttle control.

The valve controller may be configured to not adjust the throttle opening of the first throttle-valve set within a dead band corresponding to a predetermined range from a substantially zero detection position of the amount of throttle work which is detected by the throttle positioning sensor.

The first throttle-valve set may be a cable-driven throttle-valve set which is interlocked with a twist grip throttle control through a cable. The second throttle-valve set may be a motor-driven throttle-valve set driven by a motor based on a control signal being given.

The motor-driven throttle-valve set may be configured so that the throttle opening thereof is controlled to follow the throttle opening of the cable-driven throttle-valve set with a predetermined delay.

The throttle valve control device may further include a second throttle valve positioning sensor configured to detect the throttle opening of the motor-driven throttle-valve set.

The cable-driven throttle-valve set may be provided to the cylinders which are adjacently arranged.

The throttle valve control device may further include a throttle operating grip configured to operable by the operator. The throttle positioning sensor may be attached to the throttle operating grip, and configured to detect an amount of operation of the throttle operating grip. The throttle valve control device may be configured to not adjust the throttle opening of the second throttle-valve set when the amount of operation of the throttle operating grip detected by the throttle positioning sensor is within a predetermined range.

The throttle positioning sensor may be configured so as to output a substantially zero detection value within the predetermined range.

The throttle valve control device may further include an actuator configured to drive the second throttle-valve set so that the throttle opening of the second throttle-valve set is adjusted based on a control value from the valve controller. The valve controller may be configured to not drive the actuator when the amount of throttle work detected by the throttle positioning sensor is within a predetermined range.

The throttle valve control device may further include an intermediate mechanism configured to transmit an operation of the throttle work through a wire. The throttle positioning sensor may be attached to the intermediate mechanism. The throttle positioning sensor may be configured to detect an amount of operation of the intermediate mechanism. The throttle valve control device may be configured to not adjust the throttle opening of the second throttle-valve set when the amount of throttle work detected by the throttle positioning sensor is within a predetermined range.

The above and further objects and features of the invention will more fully be apparent from the following detailed description with accompanying drawings.

DETAILED DESCRIPTION OF THE INVENTION

The present invention will now be described in detail referring to the accompanying drawings illustrating the embodiments thereof.

(Embodiment 1)

Figure 1:
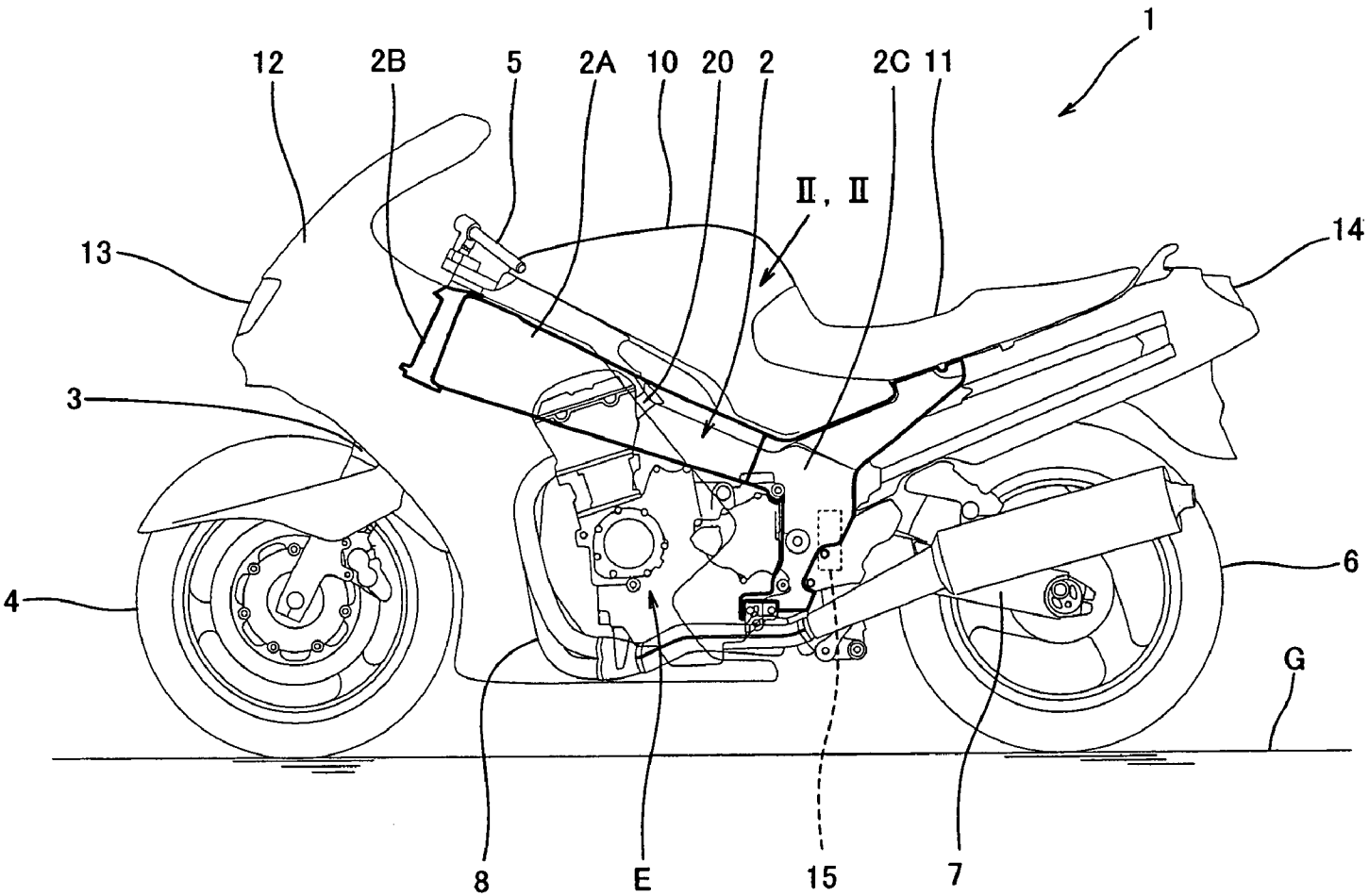
FIG. 1 is a left side view of a motorcycle as a leisure vehicle on which a multi-cylinder engine is mounted, according to a first embodiment of the present invention.

FIG. 1 is a side view illustrating a road sports type motorcycle as one example of a leisure vehicle. As shown in FIG. 1, the motorcycle 1 includes a frame 2 which forms a framework of a body of the motorcycle 1. The frame 2 includes a pair of main frames 2A (only the left-side main frame 2A is shown in FIG. 1), which extend in the longitudinal direction of the motorcycle 1, and are arranged side by side distanced in the width direction of the motorcycle 1, a head pipe 2B that connects front portions of the main frames 2A together, and a pivot frame 2C coupled to rear portions of the main frames 2A.

A pair of front forks 3 rotatably support a front wheel 4 at lower portions. The front forks 3 are supported by the head pipe 2B so as to be rotatable about a substantially vertical axis. A handlebar 5 is rotatably provided in upper portions of the front forks 3. A rear portion of the pivot frame 2C pivotably supports a front portion of a swing arm 7. The swing arm 7 rotatably supports a rear wheel 6, which is a drive wheel, at a rear portion thereof. An engine E is mounted between the left and right main frames 2A so that an upper portion of the engine E is located therebetween.

In this embodiment, the engine E is an in-line four-cylinder four-cycle engine and outputs a torque according to an amount of intake air supplied through a multi-throttle valve 20 (also see FIG. 2) which will be described in detail later. The torque outputted by the engine E is transmitted through a chain or belt mechanism (not shown) to the rear wheel 6 to give a propulsion force to the motorcycle 1. A fuel tank 10 is disposed above the engine E. A seat 11, which an operator straddles, is disposed behind the fuel tank 10.

A fairing 12 is provided so as to cover the motorcycle 1 from an upper front face of the front forks 3 to side faces of the frame 2 and the engine E. A headlight 13 is provided so as to be buried in a front face of the fairing 12. A taillight 14 is mounted behind the seat 11. The headlight 13 and the taillight 14 are lit with electric power supplied from a battery 15 mounted on the motorcycle 1.

In the following discussion, the normal upright posture of the motorcycle 1 as shown in FIG. 1 is taken as a reference in describing orientations of components of the motorcycle 1.

Figure 2:
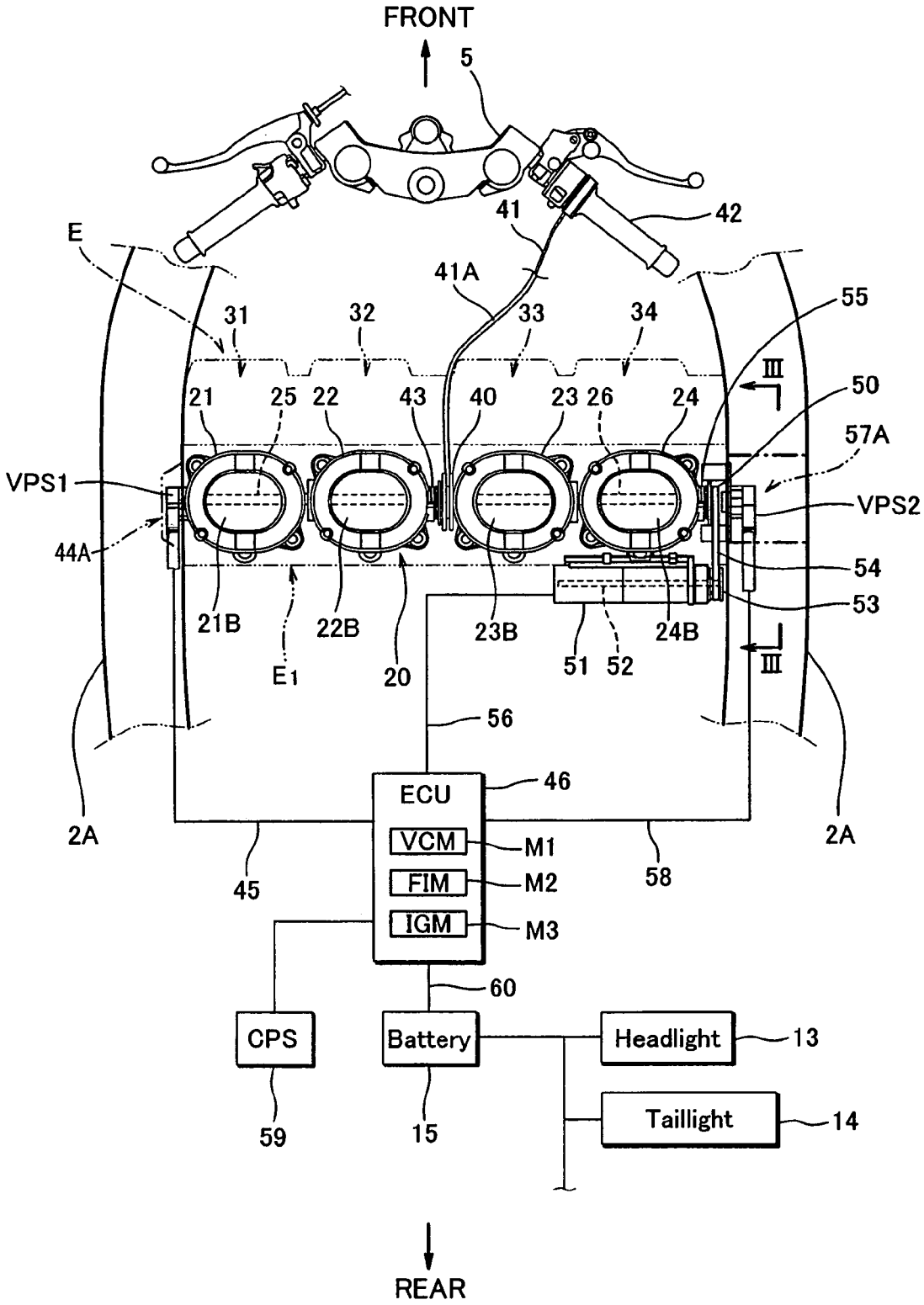
FIG. 2 is a view taken along II—II of FIG. 1 (a fuel tank is omitted), illustrating a configuration of a multi-throttle valve control device for the multi-cylinder engine shown in FIG. 1.

FIG. 2 is a II—II view of the motorcycle 1 shown in FIG. 1, from which the fuel tank 10 is removed to expose a multi-throttle valve control device. As shown in FIG. 2, the engine E includes four cylinders 31–34. A multi-throttle valve 20 is mounted to a cylinder head E1 of the engine E. The multi-throttle valve 20 includes first through fourth air-intake pipes 21–24 (the air-intake pipes are shown as an example of air-intake passages, and not limited to these) corresponding to the first through fourth cylinders 31–34, respectively. The first through fourth air-intake pipes 21–24 are connected to respective air-intake ports (not shown), provided for the first through fourth cylinders 31–34, respectively.

First through fourth throttle valves 21B–24B are provided in the first through fourth air-intake pipes 21–24, respectively. Among them, two throttle valves 21B and 22B on the left side are rotatably supported integrally by a first throttle valve shaft 25. Similarly, the remaining two throttle valves 23B and 24B on the right side are rotatably supported integrally by a second throttle valve shaft 26, which is independent of the first throttle valve shaft 25. In other words, the two throttle valves 21B and 22B on the left side are operated integrally with the same degree of opening at all times, and the two throttle valves 23B and 24B on the right side are also operated integrally with the same degree of opening at all times. However, the left-side valve set and the right-side valve set are mechanically independent of each other.

A first pulley 40 is provided to a right end portion of the first throttle valve shaft 25 between the second air-intake pipe 22 and the third air-intake pipe 23 so that it rotates integrally with the first throttle valve shaft 25. One end portion of a cable 41 inserted through a tube 41A is connected to the first pulley 40. The other end portion of the cable 41 is connected to a twist grip throttle control (TGTC) 42 which is an example of the throttle operating portion provided in a right side portion of the handlebar 5. A first return spring 43 is provided adjacent the first pulley 40. The first return spring 43 biases the first throttle valve shaft 25 so that it urges the first throttle valve 21B and the second throttle valve 22B to be in a fully-closed state.

As seen from FIG. 2, since the first pulley 40 connected to the cable 41 is provided between the second air-intake pipe 22 and the third air-intake pipe 23, the cable 41 which extends between the twist grip throttle control 42 and the first pulley 40 may have a relatively large curvature. Therefore, the operability is typically good when the operator operates the twist grip throttle control 42. In other words, if the cable (typically, a push-pull cable) 41 has a large curvature, friction inside thereof is less when it is operated. Thus, the operator is required a less operational force to operate the twist grip throttle control 42. It should be noted that the first pulley 40 may be arranged between the first air-intake pipe 21 and the second air-intake pipe 22, or on the left side portion of the first air-intake pipe 21. In this case, it is possible to arrange the cable 41 with a further greater curvature, and an even better operability of the twist grip throttle control 42 may be obtained.

When the operator operates to turn the twist grip throttle control 42, the first pulley 40 and the first throttle valve shaft 25 rotate integrally. Then, the first throttle valve 21B and the second throttle valve 22B are driven to open/close according to an amount of operation of the twist grip throttle control 42 (an amount of throttle work). When the operator releases the twist grip throttle control 42, the first throttle valve shaft 25 is rotated in a closing direction by the biasing force of the first return spring 43, and the first throttle valve 21B and the second throttle valve 22B are brought into the fully-closed state. In this way, the first throttle valve 21B and the second throttle valve 22B constitute a "cable-driven type throttle-valve set," which is driven by the operator's operation of the twist grip throttle control 42 directly via the cable 41.

A valve positioning sensor VPS1 is provided on a left side end portion of the first throttle valve shaft 25. The valve positioning sensor VPS1 detects the throttle opening of the first throttle valve 21B and the second throttle valve 22B, and converts it into an electric signal to output. The outputted electric signal is transmitted to a valve controller which is mounted on the motorcycle 1 and connected to the valve positioning sensor VPS1 through a connecting line 45. In this embodiment, the valve controller is illustrated as an ECU (Electronic Control Unit) 46.

A second pulley 50 is provided on a right end portion of the second throttle valve shaft 26 on the right side of the fourth air-intake pipe 24 so that it rotates integrally with the second throttle valve shaft 26. Disposed below the fourth air-intake pipe 24 is a DC electric motor 51. A third pulley 53 is provided on an output shaft 52 of the electric motor 51, which protrudes rightward. A belt 54 is wound around the second pulley 50 and the third pulley 53. A second return spring 55 is provided adjacent the second pulley 50 on the second throttle valve shaft 26. The second return spring 55 biases the second throttle valve shaft 26 so that it urges the third throttle valve 23B and the fourth throttle valve 24B to be in a fully-closed state. The electric motor 51 is electrically connected with the ECU 46 by a connecting line 56, and rotates in response to a control signal from the ECU 46.

The electric motor 51 rotates the output shaft 52, and a rotational force of the output shaft 52 is transmitted through the second pulley 50, the third pulley 53, and the belt 54, thus rotating the second throttle valve shaft 26. As a result, the third throttle valve 23B and the fourth throttle valve 24B are driven to open/close to a throttle opening according to the control signal from the ECU 46. When the drive current for the electric motor 51 is reduced according to the control signal from the ECU 46, the second throttle valve shaft 26 rotates in the closing direction by the biasing force of the second return spring 55 and, then, the third throttle valve 23B and the fourth throttle valve 24B are brought into the fully-closed state. Thus, the third throttle valve 23B and the fourth throttle valve 24B constitute a "motor-driven throttle-valve set," which is driven by the electric motor 51 based on the control signal.

A valve positioning sensor VPS2 is provided on a right end portion of the second throttle valve shaft 26. The valve positioning sensor VPS2 detects the throttle opening of the third throttle valve 23B and the fourth throttle valve 24B, converts it into an electric signal to output. The outputted electric signal is transmitted to the ECU 46 which is connected to the valve positioning sensor VPS2 through a connecting line 58.

Also connected to the ECU 46 is a crankshaft positioning sensor (CPS) 59 which operates by electric power supplied from the battery 15 connected through a power line 60, and detects an engine speed of the engine E. The battery 15 supplies electric power to various electric and electronic components connected thereto, such as the ECU 46. The battery 15 also supplies electric power to the headlight 13 and the taillight 14.

Figure 4:
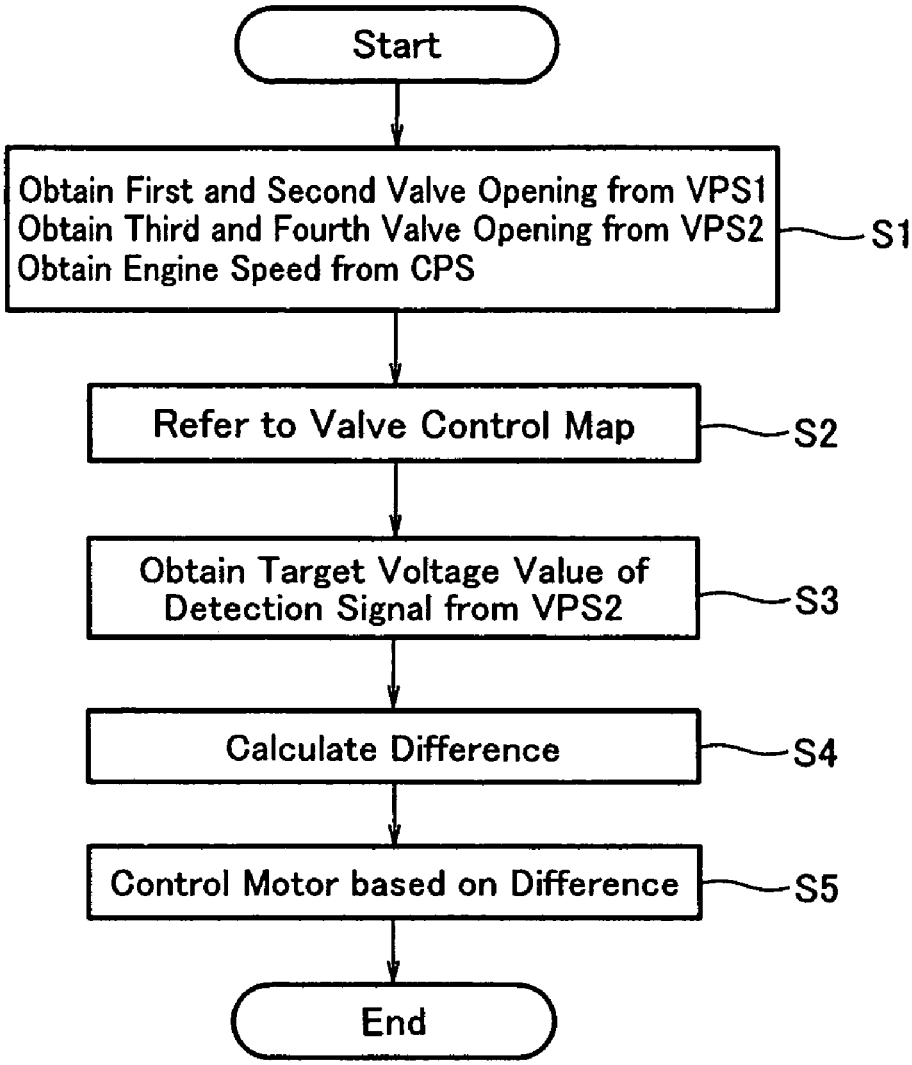
FIG. 4 is a flowchart showing a control operation of the multi-throttle valve control device shown in FIG. 2.

Next, with reference to a flowchart of FIG. 4, an example of a control routine of the ECU 46 to drive the third throttle valve 23B and the fourth throttle valve 24B (this routine typically is repeatedly performed) is described.

As shown in FIG. 4, in Step 1, the ECU 46 obtains a voltage value of the detection signal from the valve positioning sensor VPS1 (for example, 2.0V) as the throttle opening of the first throttle valve 21B and the second throttle valve 22B. The ECU 46 also obtains a voltage value of the detection signal from the valve positioning sensor VPS2 (for example, 1.2V) as the throttle opening of the third throttle valve 23B and the fourth throttle valve 24B. Further, the ECU 46 obtains an engine speed of the engine E from the crankshaft positioning sensor (CPS) 59 (for example, 5000 rpm). Next, the ECU refers to the Valve Control Map (VCM) M1 (see FIG. 5) which is stored in a memory within the ECU 46 (Step S2).

Figure 5:
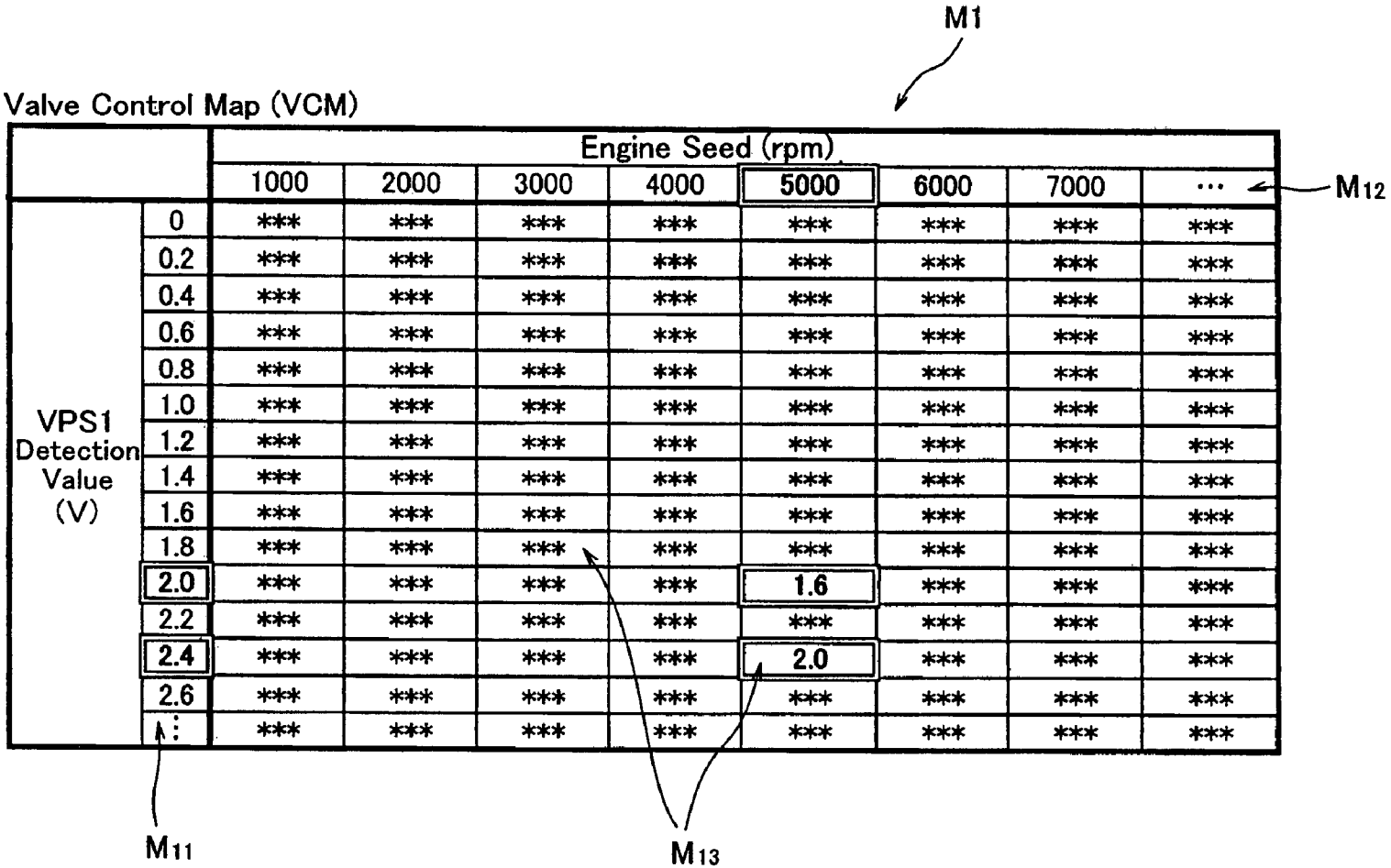
FIG. 5 is a table illustrating an example of a Valve Control Map (VCM) for the multi-throttle valve control device shown in FIG. 2.

The Valve Control Map M1 is for obtaining a target throttle opening of the third throttle valve 23B and the fourth throttle valve 24B based on the engine speed obtained in Step S1 and the throttle opening of the first throttle valve 21B and the second throttle valve 22B. FIG. 5 shows an example of the Valve Control Map M1. The Valve Control Map M1 typically contains throttle openings of the first throttle valve 21B and the second throttle valve 22B, that is, voltage values (V) of the detection signals from the valve positioning sensor VPS1 as column items M11. The Valve Control Map M1 also contains engine speeds (rpm) as row items M12. Further in the Valve Control Map M1, target throttle openings of the third throttle valve 23B and the fourth throttle valve 24B, that is, target voltage values (V) of the detection signal from the valve positioning sensor VPS2, are given as respective cells M13 so as to be associated with the column items M11 and the row items M12 described above.

For example, as shown in FIG. 5, if the voltage value of the detection signal from the valve positioning sensor VPS1 is 2.0V and the engine speed from the crankshaft positioning sensor 59 is 5000 rpm, the target voltage value of the detection signal from the valve positioning sensor VPS2 is 1.6V. Further from this state, if the operator operates the twist grip throttle control 42 and the engine speed is 5000 rpm as in the above-described case but the voltage value of the detection signal from the valve positioning sensor VPS1 becomes 2.4V, the target voltage value of the detection signal from the valve positioning sensor VPS2 is 2.0V.

In this way, the target voltage value of the detection signal from the valve positioning sensor VPS2 typically is set in such a manner that it increases with a slight delay (1.6V to 2.0V) with respect to an increase of the voltage value of the detection signal from the valve positioning sensor VPS1 (2.0V to 2.4V). In other words, the change in throttle opening of the third throttle valve 23B and the fourth throttle valve 24B is slightly delayed with respect to the change of throttle opening of the first throttle valve 21B and the second throttle valve 22B. It should be noted that there are cells that contain "*" in the Valve Control Map M1 shown in FIG. 5. In fact, these cells may also contain appropriate target voltage values of the detection signal from the valve positioning sensor VPS2**.

Next, by referring to the Valve Control Map M1, the ECU 46 obtains a target voltage value of the detection signal from the valve positioning sensor VPS2 (for example, 2.0V) (Step S3), and calculates a difference value between this target voltage value and the voltage value of the detection signal from the valve positioning sensor VPS2 which is obtained in Step S1 (Step S4). Specifically, if a (current) voltage value of the detection signal from the valve positioning sensor VPS2 obtained in Step S1 is 1.2V and the target voltage value obtained in Step S3 is 2.0V, the difference value obtained by subtracting the current voltage value from the target voltage value is 0.8V, and this value is the difference obtained in Step S4. The ECU 46 controls the electric motor 51 according to the obtained difference value (so as to bring the difference value to zero) (Step S5). As a result, the third throttle valve 23B and the fourth throttle valve 24B are driven so that the voltage value of the detection signal from the valve positioning sensor VPS2 matches the target voltage value obtained in Step S3 as described above.

In addition, the ECU 46 also controls the operations of fuel injection and ignition (not shown) based on the detection signals from the valve positioning sensor VPS1 and the valve positioning sensor VPS2 and the detection signal from the crankshaft positioning sensor 59.

Figure 6:
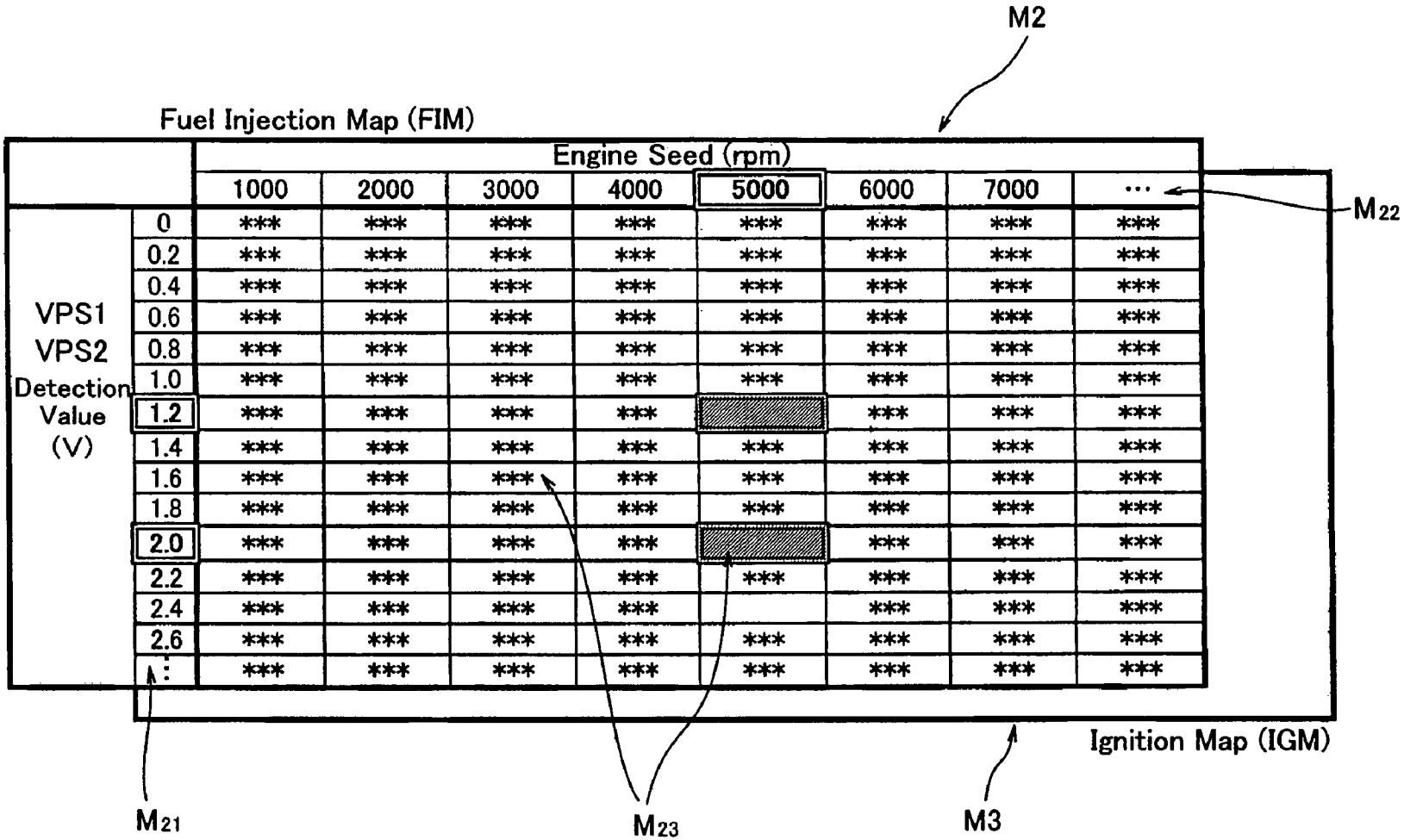
FIG. 6 is a table showing examples of a Fuel Injection Map (FIM) and an Ignition Map (IGM) for the multi-throttle valve control device shown in FIG. 2.

FIG. 6 is tables showing a Fuel Injection Map (FIM) M2 for obtaining a fuel injection amount and an Ignition Map (IGM) M3 for obtaining an ignition timing to the air-fuel mixture. The Fuel Injection Map M2 typically contains voltage values (Volt) of the detection signal from the valve positioning sensor VPS1 and the valve positioning sensor VPS2 as its column items M21. The Fuel Injection Map M2 may also contain engine speeds (rpm) as its row items M22. Fuel injection amounts are associated with the column items M21 and row items M22 described above and are given to respective cells M23. The ECU 46 refers to the Fuel Injection Map M2 and obtains fuel injection amounts for the cylinders 31–34 upon obtaining the detection signals from the valve positioning sensor VPS1, the valve positioning sensor VPS2, and the crankshaft positioning sensor 59.

Although the contents of the Ignition Map M3 are omitted in FIG. 6, the Ignition Map M3 has the same column items and row items as those of the above-noted Fuel Injection Map M2 and each cell is given with the ignition timing.

Meanwhile, in this embodiment, the engine E has four cylinders which are laterally aligned in one line as shown in FIG. 2. The first cylinder 31 and the fourth cylinder 34 have a geometrically symmetrical configuration in the width direction, and phases of the crank angle corresponding to these cylinders are the same. Similarly, the second cylinder 32 and the third cylinder 33 have a geometrically symmetrical configuration in the width direction, and phases of the crank angle corresponding to the cylinders are the same. That is, the Fuel Injection Map M2 and the Ignition Map M3 for the first cylinder 31 and the Fuel Injection Map M2 and Ignition Map M3 for the fourth cylinder 34 may have substantially the same contents. Similarly, for the second cylinder 32 and the third cylinder 33 as well, their respective Fuel Injection Map M2 and Ignition Map M3 may have substantially the same contents.

Now, by the operation of the ECU 46 as mentioned with FIG. 4, the cylinders 31–34 operate in the following manner when the operator operates the twist grip throttle control 42.

Figure 7:
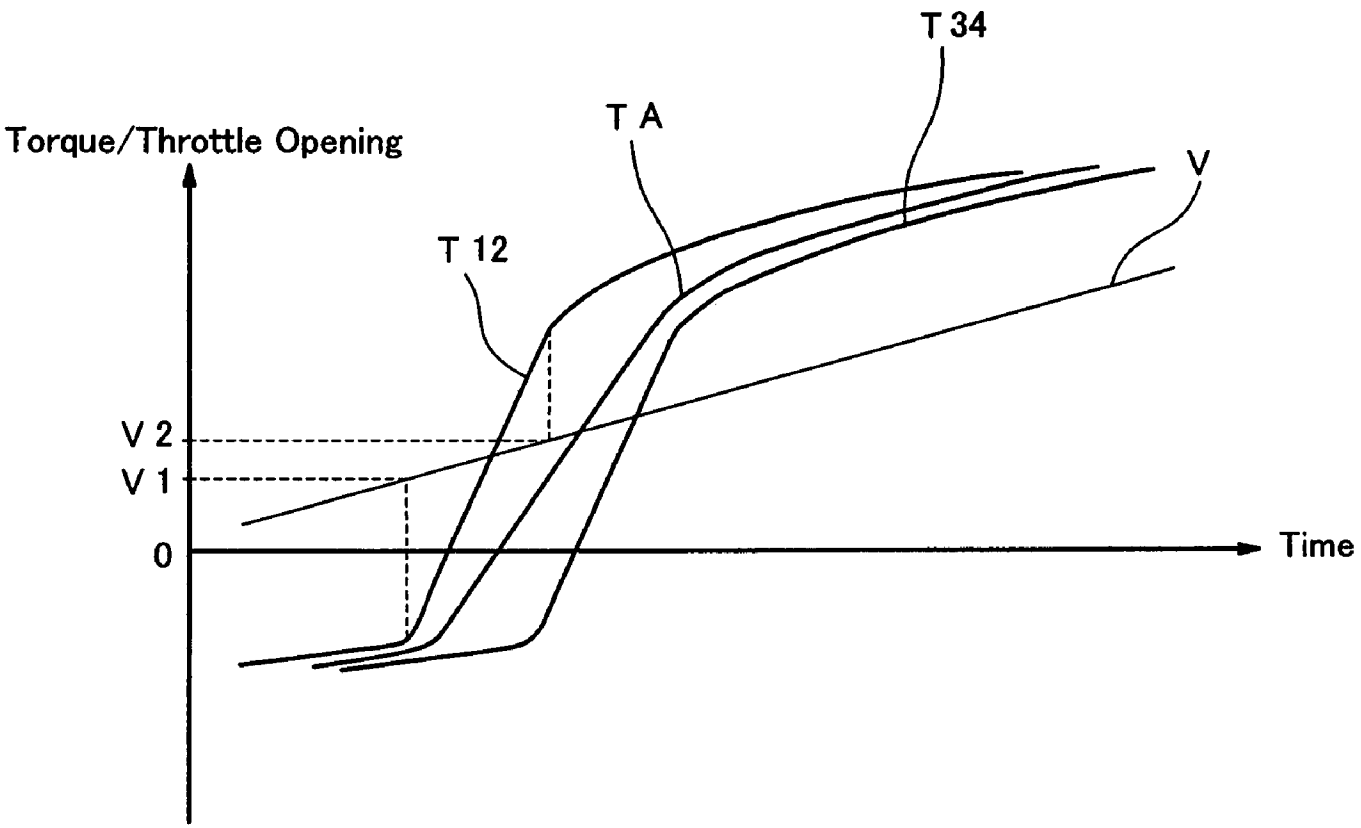
FIG. 7 is a graph showing an example of a time sequential change in a maximum output torque of each cylinder and a time sequential change in an average maximum output torque per one cylinder, when an operator operates a twist grip throttle control (TGTC) in such a manner as to gradually open a first throttle valve through a fourth throttle valve from a state in which the valves are in a substantially fully-closed state in the first embodiment.

FIG. 7 is a graph showing an example of time sequential change in maximum output torques of the cylinders 31–34 and time sequential change in an average maximum output torque per one cylinder, when the operator gradually opens the twist grip throttle control 42 from a substantially fully-closed state of the first through fourth throttle valves 21B–24B. In this graph, a thin line V represents a change in the throttle opening of the first throttle valve 21B and the second throttle valve 22B while opening the twist grip throttle control 42. A thick line T12 represents a change in the output torque of the first cylinder 31 (#1) or the second cylinder 32 (#2). A thick line T34 represents a change in the output torque of the third cylinder 33 (#3) or the fourth cylinder 34 (#4). A thick line TA represents a change in the average output torque per one cylinder.

As indicated by the thick lines T12 and T34 in FIG. 7, the output torques of the first cylinder 31 through the fourth cylinder 34 increase as the twist grip throttle control 42 is operated to open the first throttle valve 21B and the second throttle valve 22B. The first cylinder 31 and the second cylinder 32 outputs, as indicated by the thick line T12, a negative torque that gradually increases while the throttle opening is relatively small. After the throttle opening reaches a certain value V1, the output torque increases at a relatively large rate and changes from negative to positive. Then, after the throttle opening reaches another certain value V2 that is greater than V1 (that is, V2>V1), the output torque again shows a gradual increase. Meanwhile, the output torque of the third cylinder 33 and the fourth cylinder 34 shows, as indicated by the thick line T34, increases so as to follow the change of the output torque of the first cylinder 31 and the second cylinder 32 with a slight delay as described above.

The average maximum torque per one cylinder of the engine E is a value obtained by dividing the outputted torque from the first cylinder 31 through the fourth cylinder 34 at the same time by the number of cylinders (i.e., four in this case). Therefore, its time sequential change shows, as indicated by the thick line TA in FIG. 7, a more gradual increase as a whole than the time sequential changes in the torques of the first cylinder 31 through the fourth cylinder 34. Consequently, the engine E outputs a torque such as to smoothly change according to the operation of the twist grip throttle control 42 by the operator.

Figure 8:
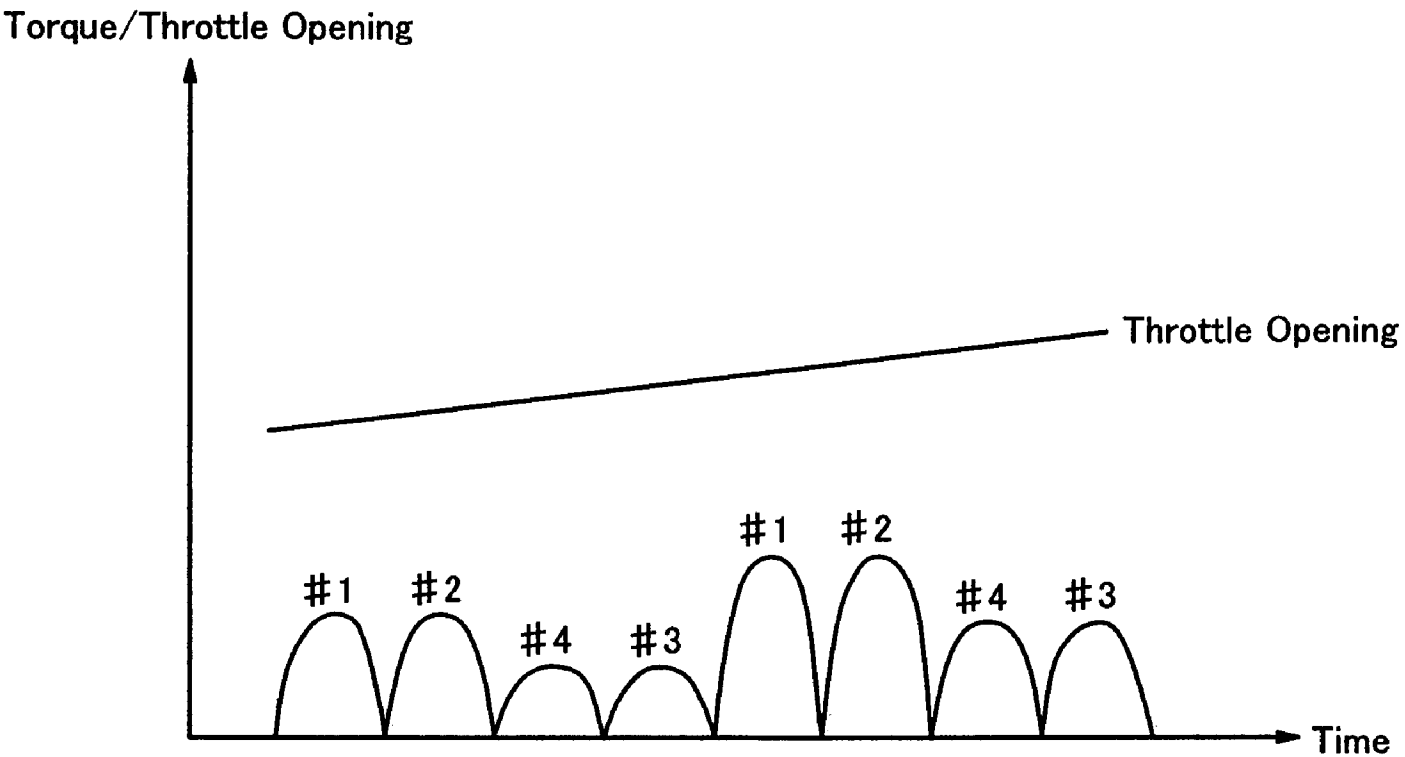
FIG. 8 is a graph showing examples of torques that are outputted by the first cylinder through the fourth cylinder when a throttle opening of the first throttle valve and the second throttle valve is taken as a reference and the throttle opening is gradually increased over time, in the first embodiment.

FIG. 8 is a graph showing examples of torques that are outputted by the first cylinder 31 through the fourth cylinder 34 when the throttle opening of the first throttle valve 21B and the second throttle valve 22B is taken as a reference and the throttle opening is gradually increased over time. As shown in FIG. 8, combustions in this engine E proceed subsequently from the first cylinder 31 (#1), the second cylinder 32 (#2), the fourth cylinder 34 (#4), and to the third cylinder 33 (#3). Accordingly, the first cylinder 31 and the second cylinder 32 which correspond to the cable-driven type throttle valves (the first throttle valve 21B and the second throttle valve 22B) subsequently undergo the combustion strokes. Then, the third cylinder 33 and the fourth cylinder 34 which correspond to the motor-driven throttle valves (the third throttle valve 23B and the fourth throttle valve 24B) subsequently undergo the combustion strokes.

As explained with FIG. 8, the output torques of the third cylinder 33 and the fourth cylinder 34 increase with a slight delay from the increase in the output torques of the first cylinder 31 and the second cylinder 32. Therefore, as shown in FIG. 8, the third cylinder 33 and the fourth cylinder 34 output less torque than the immediately preceding output torque of the first cylinder 31 and the second cylinder 32.

When controlling the torques that are outputted by the cylinders 31–34 in this manner, the pressure to ground G applied by the rear wheel 6 which is the drive wheel (see FIG. 1) changes intermittently, and generates relatively strong traction. Thus, such a strong traction produces a large, desirable acceleration force especially when the motorcycle 1 is accelerated from a standstill state or from a low-speed traveling state.

In this embodiment, the control of the engine E by the ECU 46 is accomplished by using various types of control maps that may be prepared in advance. However, this is to be considered as not restrictive, and for example, the control may be achieved by using one or more arithmetic equations that take an engine speed (rpm) and a throttle opening (%) of the first throttle valve 21B and the second throttle valve 22B detected by the valve positioning sensor VPS1 as input values and yield a target throttle opening (%) of the third throttle valve 23B and the fourth throttle valve 24B as the output value.

In this embodiment, the in-line four cylinder four-cycle engine has been illustrated as an example, but engines to which the present invention can be applied are not limited to this type. The present invention may be suitably applied, without any limitation, to any engines having two or more cylinders, such as straight four cylinder engines and V-type two cylinder engines.

In this embodiment, the road sports type motorcycle has been described as one example of the leisure vehicle, but this is for illustrative purposes only. For example, the present invention may be applied to various vehicles that have drive wheel(s), such as a cruiser type motorcycle or a motocross type motorcycle and an all terrain vehicle, as well as a personal watercraft (PWC) and the like that has a water jet pump as a propulsion mechanism thereof.

Especially in motorcycles, since motorcycles are relatively light in weight with respective to the maximum power of the engine mounted thereon, the torque change of the engine may influence the operator's riding comfort. Therefore, it is possible to smooth the torque change of the engine and improve the operator's riding comfort by applying the multi-throttle valve that has the functions and effects as described above motorcycles. Moreover, motorcycles typically require mounting of various equipment into a narrow space, which allows only a small battery that often has insufficient electric storage capacity. For this reason, among the previously described multi-throttle valves, one that is equipped with at least one cable-driven type throttle valve is advantageous in power consumption of opening/closing the throttle valves.

In this embodiment, as shown in FIG. 1, the engine E is mounted to the motorcycle 1 so that the engine cylinders slightly lean forward. The engine E includes air-intake ports (not shown) in a rear portion of the cylinder head E1, and the multi-throttle valve 20 (also see FIG. 2) is connected to the air-intake ports. Meanwhile, exhaust ports (not shown) are provided in a front portion of the cylinder head E1. Exhaust pipes 8 extend downward from the exhaust ports and further extend rearwardly under the engine E.

Returning to FIG. 2, the multi-throttle valve 20 is arranged between the pair of left-and-right main frames 2A. A recess portion 44A is formed in an inward face (a right side face) of the left-side main frame 2A at a location corresponding to the valve positioning sensor VPS1 so that the recess portion 44A accommodates the valve positioning sensor VPS1. Accordingly, the width of the motorcycle 1 may be formed less by the width of the recess portion 44A or the width of the valve positioning sensor VPS1.

Similarly, a through hole 57A piercing in the left-and-right direction is formed in the right-side main frame 2A at a location corresponding to the valve positioning sensor VPS2 so that the through hole 57A accommodates the valve positioning sensor VPS2. Accordingly, the width of the motorcycle 1 may be formed less by the width of the through hole 57A or the width of the valve positioning sensor VPS2. The through hole 57A may be a recess portion of the right-side main frame 2A.

The above configuration is particularly useful for a vehicle with a relatively narrow mounting space for an engine equipped with a throttle valve control device because it is capable of reducing the dimensions of the multi-throttle valve, particularly in the width direction.

Figure 3A:
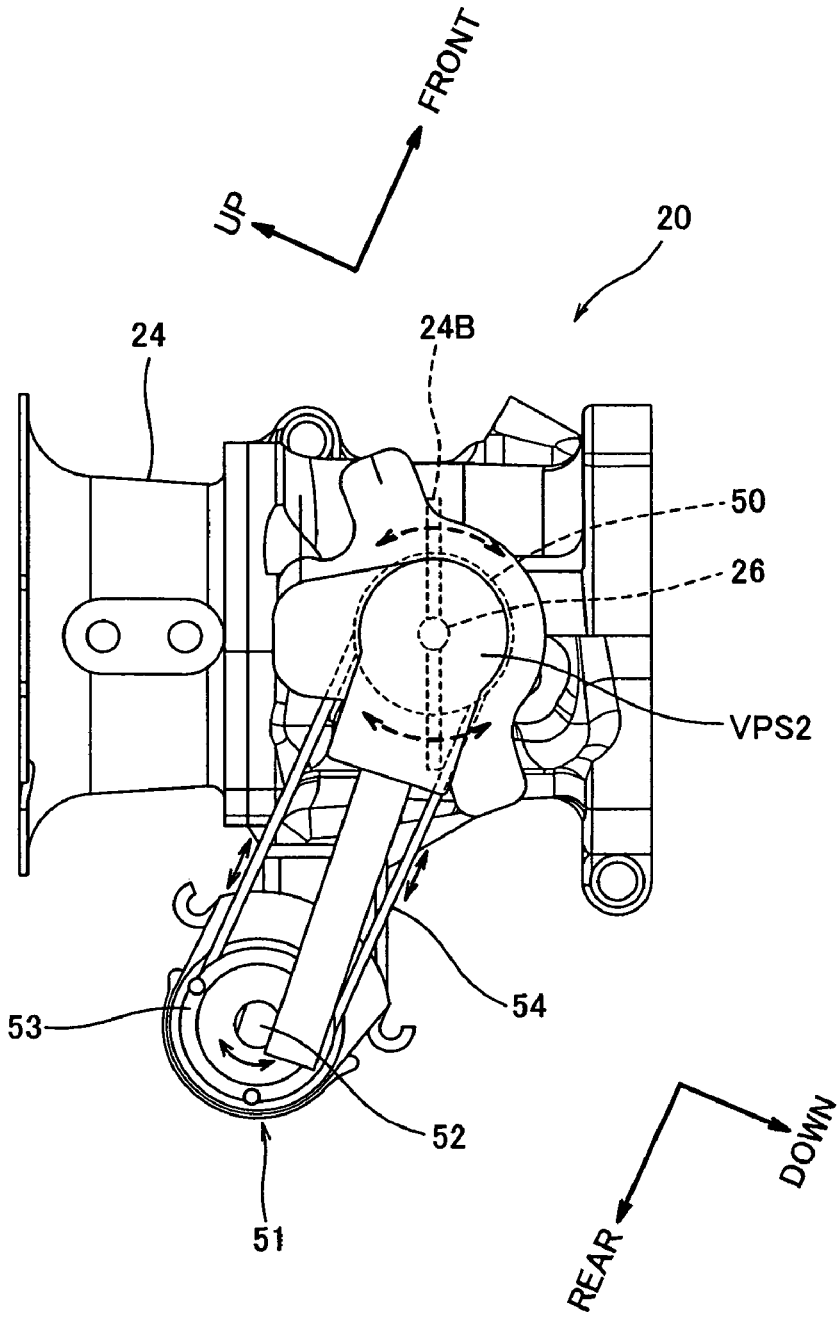
FIG. 3A is a view taken along III—III view of the multi-throttle valve in FIG. 2, illustrating an example in which a power transmission mechanism is a belt-pulley mechanism.

FIG. 3A is a III—III view of the multi-throttle valve 20 shown in FIG. 2. As shown in FIGS. 2 and 3A, the electric motor 51 is arranged below the fourth air-intake pipe 24. The electric motor 51 is configured so that the output shaft 52 has a relatively small radial dimension but a relatively large axial dimension. The electric motor 51 is arranged so that the output shaft 52 is parallel to the second throttle valve shaft 26. The second pulley 50 that rotates integrally with the second throttle valve shaft 26 is provided on the right-side end portion of the second throttle valve shaft 26 which is on the right side of the fourth air-intake pipe 24. The output shaft 52 of the electric motor 51 is directed rightward, and the third pulley 53 is provided on the output shaft 52. The third pulley 53 is positioned below the second pulley 50, and the belt 54 is wound around these two pulleys.

By arranging the electric motor 51 in the above-described manner and interconnecting the output shaft 52 and the second throttle valve shaft 26 by the belt 54, it is possible to improve the response characteristics of the second throttle valve shaft 26 to the driving by the electric motor 51. At the same time, the width increase of the multi-throttle valve 20 (the dimension in the shaft length direction of the valve shafts 25 and 26) may be prevented.

Although the belt 54 has been illustrated herein as one example of the power transmission mechanism between the output shaft 52 of the electric motor 51 and the second throttle valve shaft 26, the power transmission mechanism may be any other type of power transmitting mechanism, such as a link mechanism as follows.

Figure 3B:
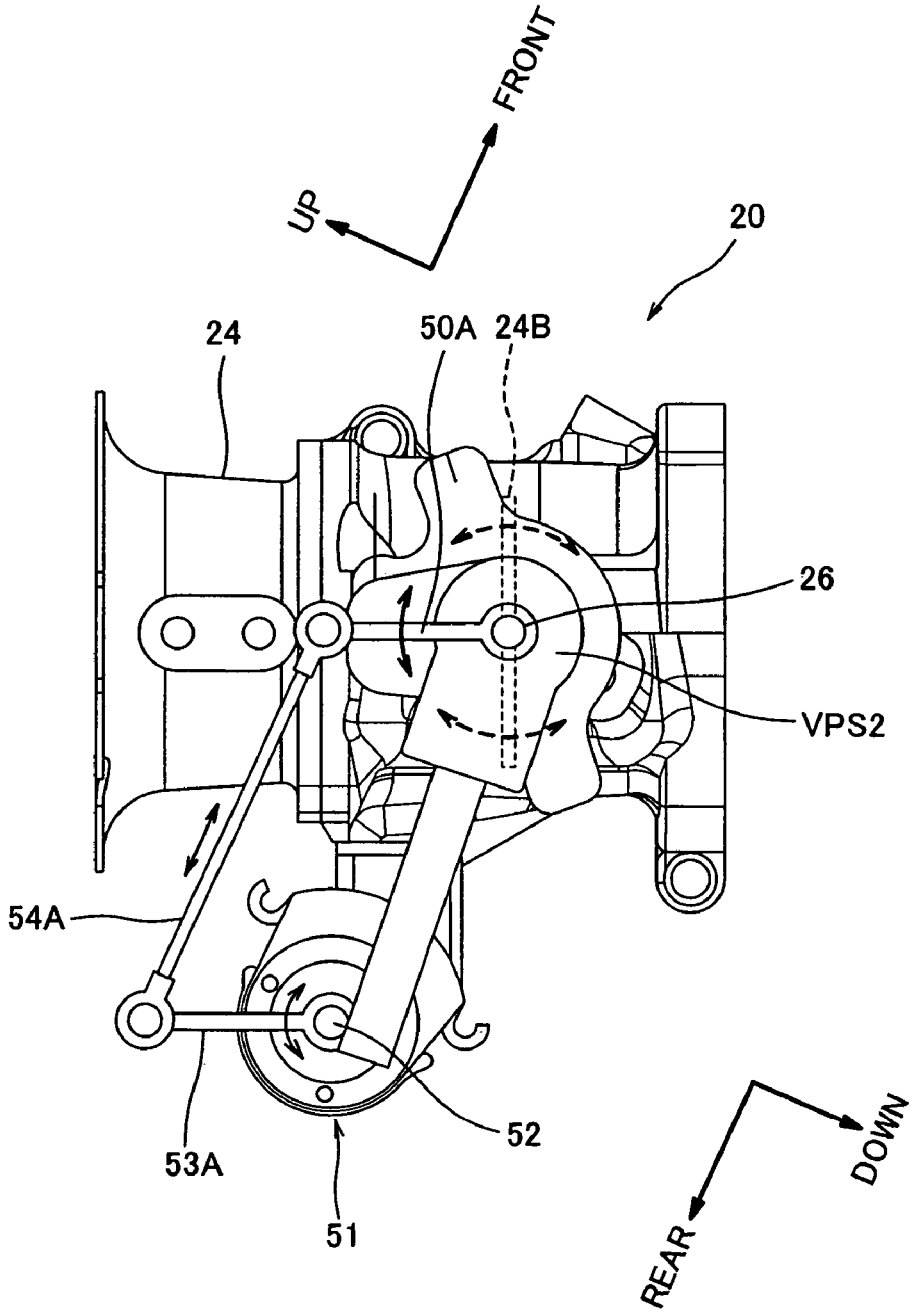
FIG. 3B is a cross-sectional view of the multi-throttle valve taken along the line III—III in FIG. 2, illustrating an example in which the power transmission mechanism is a link mechanism.

As shown in FIG. 3B, one end portion of an arm 53A is coupled to the output shaft 52 of the electric motor 51, and one end portion of an arm 50A is coupled to the second throttle valve shaft 26. The arms 53A and 50A extend in the same direction (upward) in this embodiment, and the other end portions of the two arms 53A and 50A are connected by a link 54A. In this embodiment, lengths of the arms 53A and 50A are configured to be the same so that the second throttle valve shaft 26 rotates by the same angle as an angle that the output shaft 52 of the electric motor 51 rotates. Alternatively, the power transmission mechanism may be a gear mechanism.

(Embodiment 2)

Figure 9:
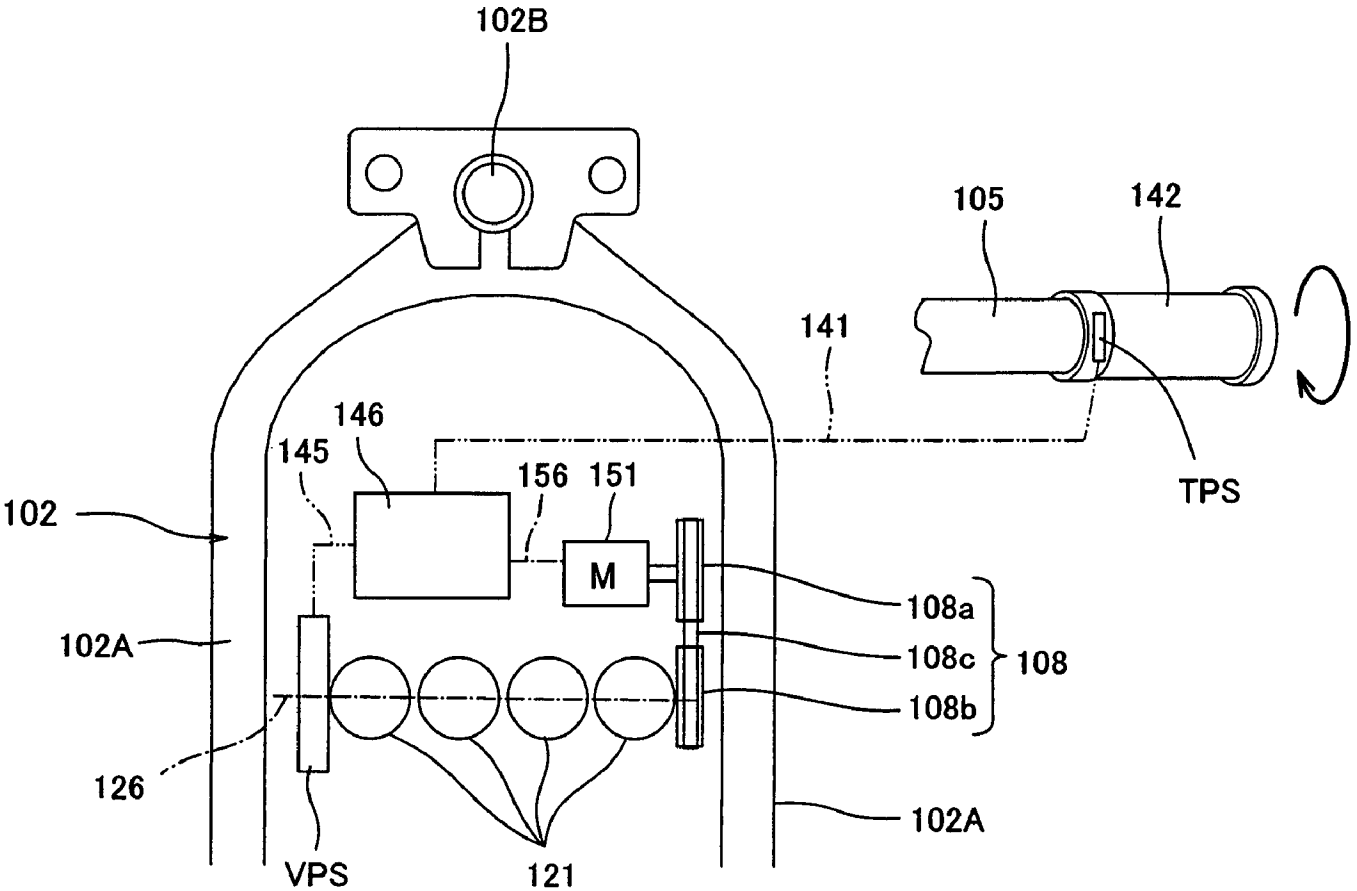
FIG. 9 is a schematic view illustrating a configuration of the multi-throttle valve control device according to second and third embodiments of the present invention, and showing a similar view being seen from the same direction as that of FIG. 2.

FIG. 9 is a view similar to FIG. 2 and seen from the same direction as FIG. 2. Although FIG. 9 schematically shows an essential portion of the second embodiment, a motorcycle in this embodiment is also equipped with a four cylinder engine, and is configured so that each of the engine cylinders has an air-intake passage. Herein, reference numerals obtained by adding 100 are used for showing similar components in the first embodiment.

In FIG. 9, reference numeral 121 denotes a plurality of throttle valves arranged in the air-intake passages. VPS denotes a valve positioning sensor that detects a movement of the throttle valves 121. Reference numeral 151 denotes an electric motor as an actuator for moving the throttle valves 121. Reference numeral 146 denotes a valve controller for controlling the electric motor 151. Reference numeral 142 denotes a twist grip throttle control (TGTC) disposed on one end (typically, on the right end) of a handlebar 105. The handlebar 105 is configured to rotate by a predetermined angle. TPS denotes a throttle positioning sensor provided to the twist grip throttle control 142.

In FIG. 9, reference numeral 102 denotes a frame of the motorcycle. The frame 102 includes a pair of main frames 102A each of which extends in the longitudinal direction of the motor cycle at the left and right side of the vehicle body, respectively. The frame 102 also includes a head pipe 102B that connects the pair of the main frames 102A together at front ends thereof on the center of the vehicle body. Although it is not shown in FIG. 9, the handlebar 105 is rotatably coupled to the head pipe 102B.

Four of the throttle valves 121 are arranged in a line in the left-and-right direction of the motorcycle, and are attached to a single, common valve shaft 126. The valve shaft 126 is driven by the electric motor 151 through a power transmission mechanism 108. In this embodiment, the power transmission mechanism 108 is constituted by a pair of timing pulleys 108*a* and 108*b* and a timing belt 108*c* wound around the pulleys. The pulley 108*a* is coupled to the output shaft of the electric motor 151. The pulley 108*b* is coupled to the valve shaft 126.

In FIG. 9, the valve positioning sensor VPS is coupled to the left end of the valve shaft 126, and the pulley 108*b* of the power transmission mechanism 108 is coupled to the right end of the valve shaft 126. It is configured so that the over all dimension of the valve shaft 126, the valve positioning sensor VPS, and the pulley 108*b* in the shaft direction is less than the distance between the left-and-right main frames 102A. In this embodiment, as shown in FIG. 9, the output shaft of the electric motor 151 and the valve shaft 126 are arranged parallel to each other. Thus, the over all dimension of the electric motor 151 including the pulley 108*a* which is coupled to the output shaft of the electric motor 151 may be less than the distance between the left-and-right main frames 102A.

A rotational position of the valve shaft 126, that is, an amount of movement of the throttle valves 121 (i.e., a throttle opening), is configured to be detected from the valve positioning sensor VPS disposed at one end of the valve shaft 126 (left end in FIG. 9). The valve positioning sensor VPS is connected to the valve controller 146 by a signal line 145. The electric motor 151 is controlled by the valve controller 146 through a control line 156. The valve controller 146 is connected to the throttle positioning sensor TPS through a signal line 141. The throttle positioning sensor TPS is configured so as to detect the operational amount of the twist grip throttle control 142 when the operator operates the twist grip throttle control 142.

Typically, the throttle positioning sensor TPS outputs a value proportional to the operational amount of the twist grip throttle control 142. The valve controller 146 typically controls such that electric power proportional to the output value from the throttle positioning sensor TPS is applied to the electric motor 151. The valve shaft 126 rotates by an angle proportional to the rotated amount of the electric motor 151, and the throttle valves 121 accordingly open by the same angle.

Figure 10:
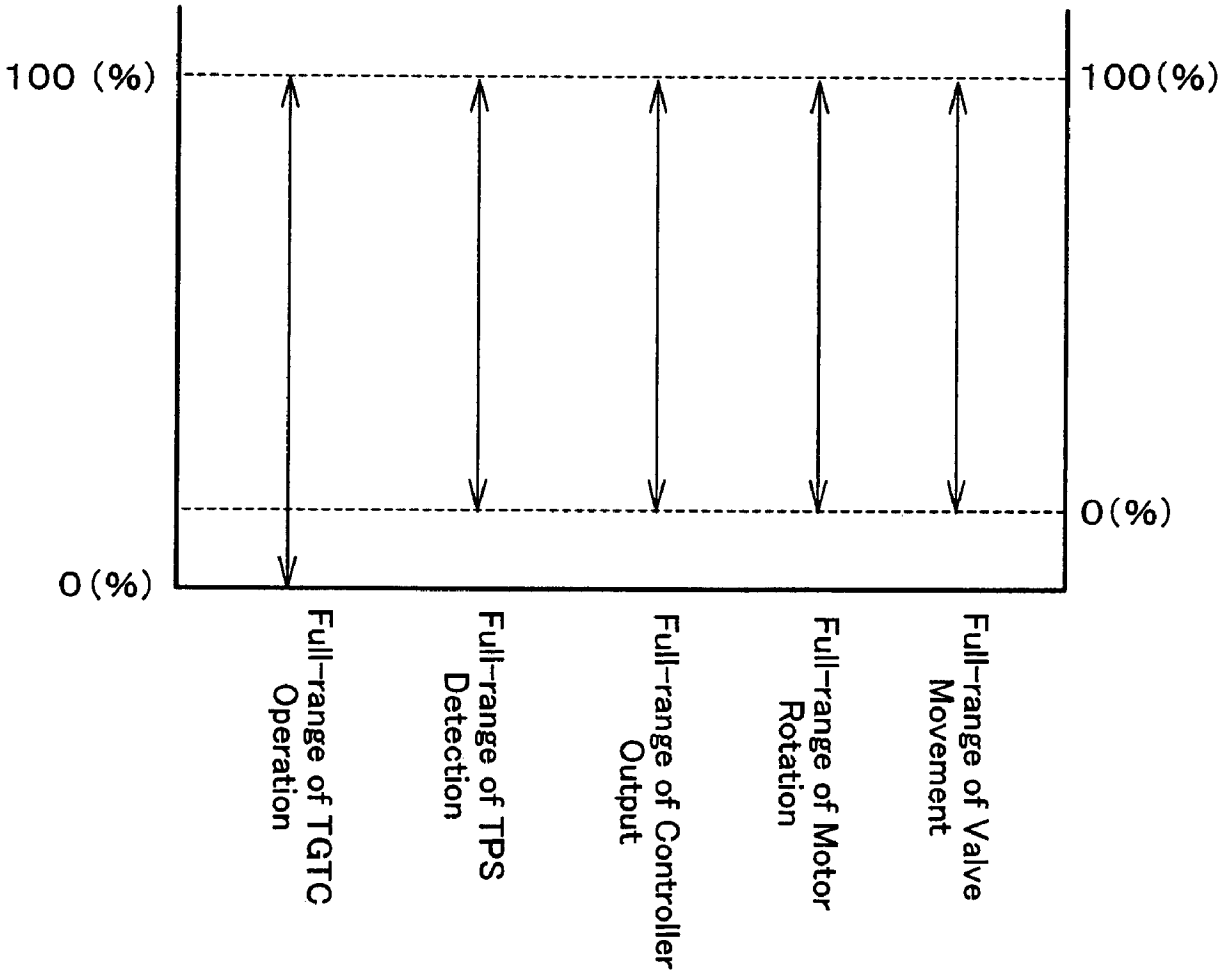
FIG. 10 is a diagram illustrating a dead band provided to a throttle positioning sensor.

It should be noted that in this embodiment, the throttle positioning sensor TPS is provided with a dead band. For example, in FIG. 9, even when the twist grip throttle control 142 is rotated in the direction indicated by the arrow to open it from the zero position (0% position shown on the left of FIG. 10, that is, the fully-closed position), the throttle positioning sensor TPS does not detect the rotation of the twist grip throttle control 142 throughout a predetermined range from the zero position (for example, about 2 degrees of the rotational angle of the twist grip throttle control 142). That is, the output value from the throttle positioning sensor TPS (TPS detection value) results in zero within this predetermined range. In other words, this predetermined range is a dead band, which is shown in FIG. 10 as a difference between a full-range of the twist grip throttle control 142 operation and a full-range of the throttle positioning sensor TPS detection corresponding thereto.

Therefore, even when the operator operates the twist grip throttle control 142 to open, the output value (TPS detection value) transmitted form the throttle positioning sensor TPS to the valve controller 146 results in zero throughout the predetermined range from the zero position. When the twist grip throttle control 142 is operated exceeding the predetermined range, the throttle positioning sensor TPS transmits an output value corresponding to the operational angle of the twist grip throttle control 142 to the valve controller 146 as a normal control.

The valve controller 146 drives the electric motor 151 based on the output value (TPS detection value). As a result, the valve shaft 126 of the throttle valves 121 is driven through the power transmission mechanism 108, and the throttle valves 121 arranged in the air-intake passages to the engine E (see FIG. 1) are opened correspondingly.

Figure 11:
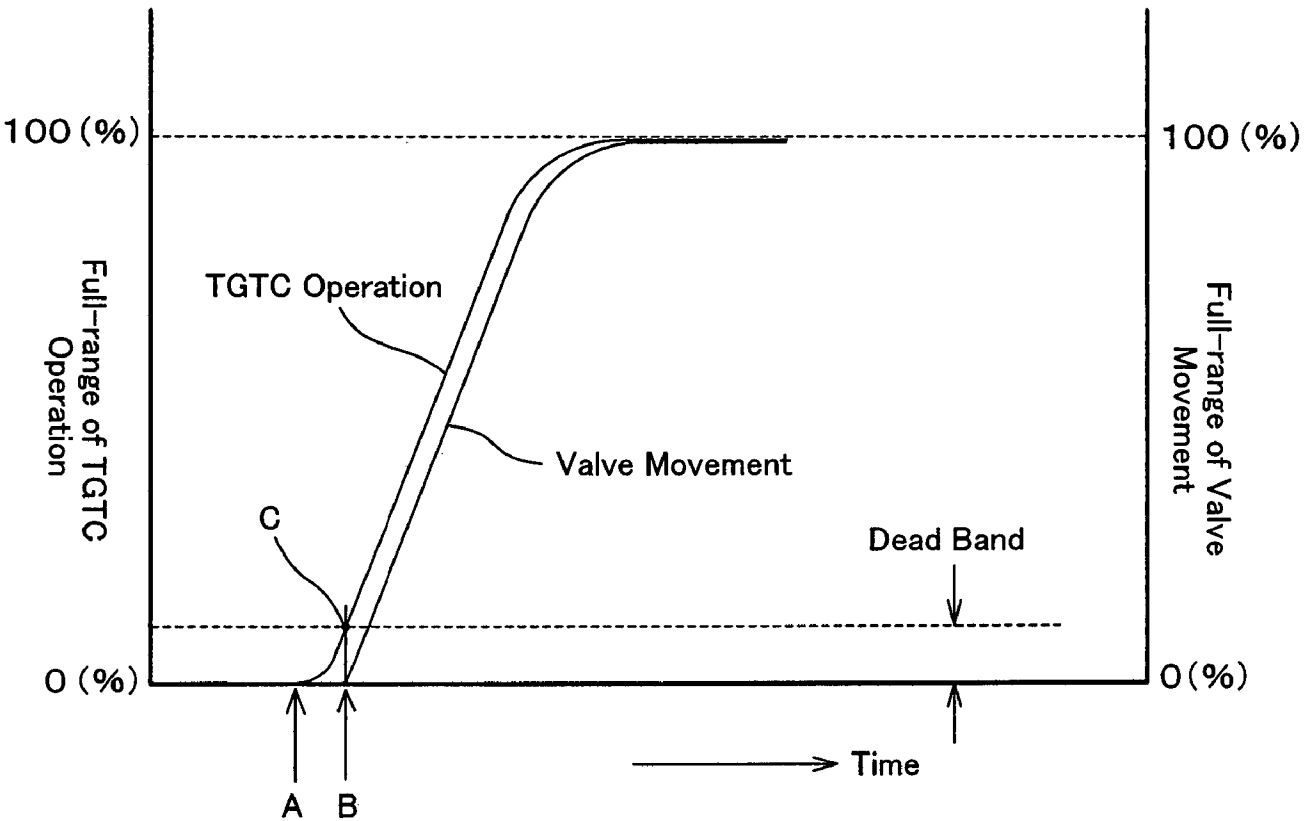
FIG. 11 is a graph illustrating the dead band provided between an operation of the twist grip throttle control and a movement of the throttle valve.

FIG. 11 shows a relationship between the amount of operation of the twist grip throttle control 142 and the amount of movement of the throttle valves 121 operated based on the amount of operation of the twist grip throttle control 142. In FIG. 11, the vertical axis on the left represents the full-range of twist grip throttle control (TGTC) operation, the vertical axis on the right represents the full range of valve movement, and the horizontal axis represents time. As shown in FIG. 11, the movement of the throttle valves 121 follows the operation of the twist grip throttle control 142 with a delay, but the amount of the delay shown in FIG. 11 is exaggerated for clarity. The delay, in fact, is not so large, and it is such that the operator may not feel the delay although he/she may be able to realize the effect of providing the dead band.

Referring to FIG. 11, the operation of the twist grip throttle control 142 is started by opening it from the zero position (at a point A), and the movement of the throttle valves 121 starts at the time when the operation of the twist grip throttle control 142 reaches a point C (at a point B). Accordingly, the operational amount of the twist grip throttle control 142 at the point B at which the movement of the throttle valves 121 is started indicates the dead band. It should be noted that in FIG. 11, the zero position of the full range of valve movement is indicated to have the same zero position as the full-range of twist grip throttle control operation so that the curves representing the operational amount of the twist grip throttle control 142 and the movement of the throttle valves 121 do not overlap.

By providing the dead band as described above, a predetermined delay is formed between the shift timing from the throttle closing operation to the throttle opening operation by the operator and the shift timing from the actual close movement to the actual open movement of the engine throttle valve. Thus, by appropriately setting the amount of the dead band, the timing of the opening operation and the operational amount that matches the vehicle speed may be accurately performed constantly.

(Embodiment 3)

Instead of providing the dead band to the throttle positioning sensor TPS, the dead band may be provided to the valve controller 146, for example. Typically, a value proportional to the operational amount of the twist grip throttle control 142 is outputted form the throttle positioning sensor TPS, and the value is transmitted to the valve controller 146, within the full detection range of the throttle positioning sensor TPS. However, in this embodiment, the valve controller 146 has a range (i.e., a dead band) in which it does not output a value proportional to the transmitted or inputted value from the throttle positioning sensor TPS.

Figure 12:
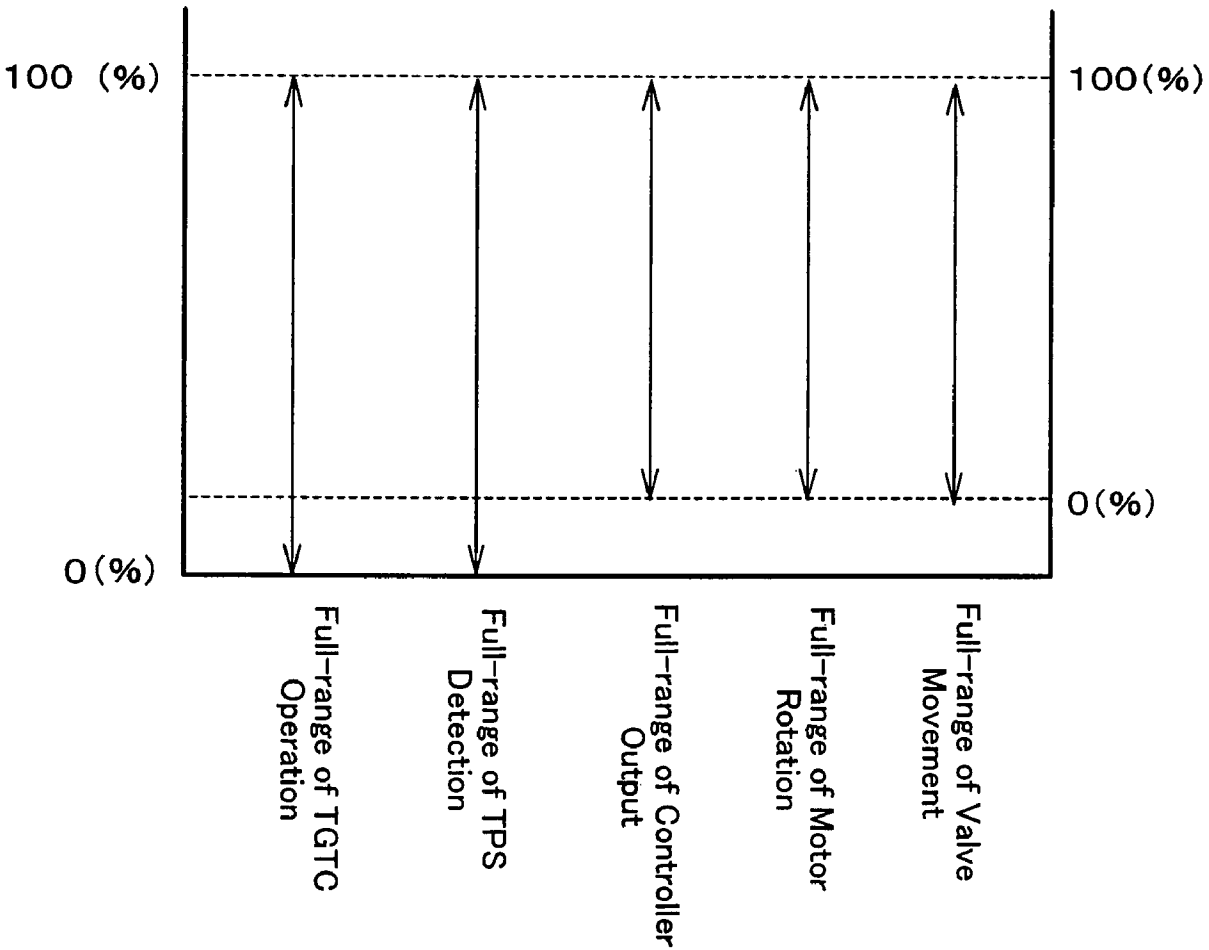
FIG. 12 is a diagram illustrating a dead band provided to a valve controller.

As shown in FIG. 12, the valve controller 146 does not output a signal that instructs the electric motor 151 to operate, based on an internal program or control chart, within a predetermined detection range of the throttle positioning sensor TPS from the zero position (which typically corresponds to approximately 2 degrees in a rotational angle of the twist grip throttle control 142). On the other hand, the valve controller 146 performs the normal proportional control outside the predetermined detection range so as to output the instruction signal. This configuration allows a dead band of the valve controller 146, resulting in the same function as that of the second embodiment shown in FIG. 11.

(Embodiment 4)

Figure 13:
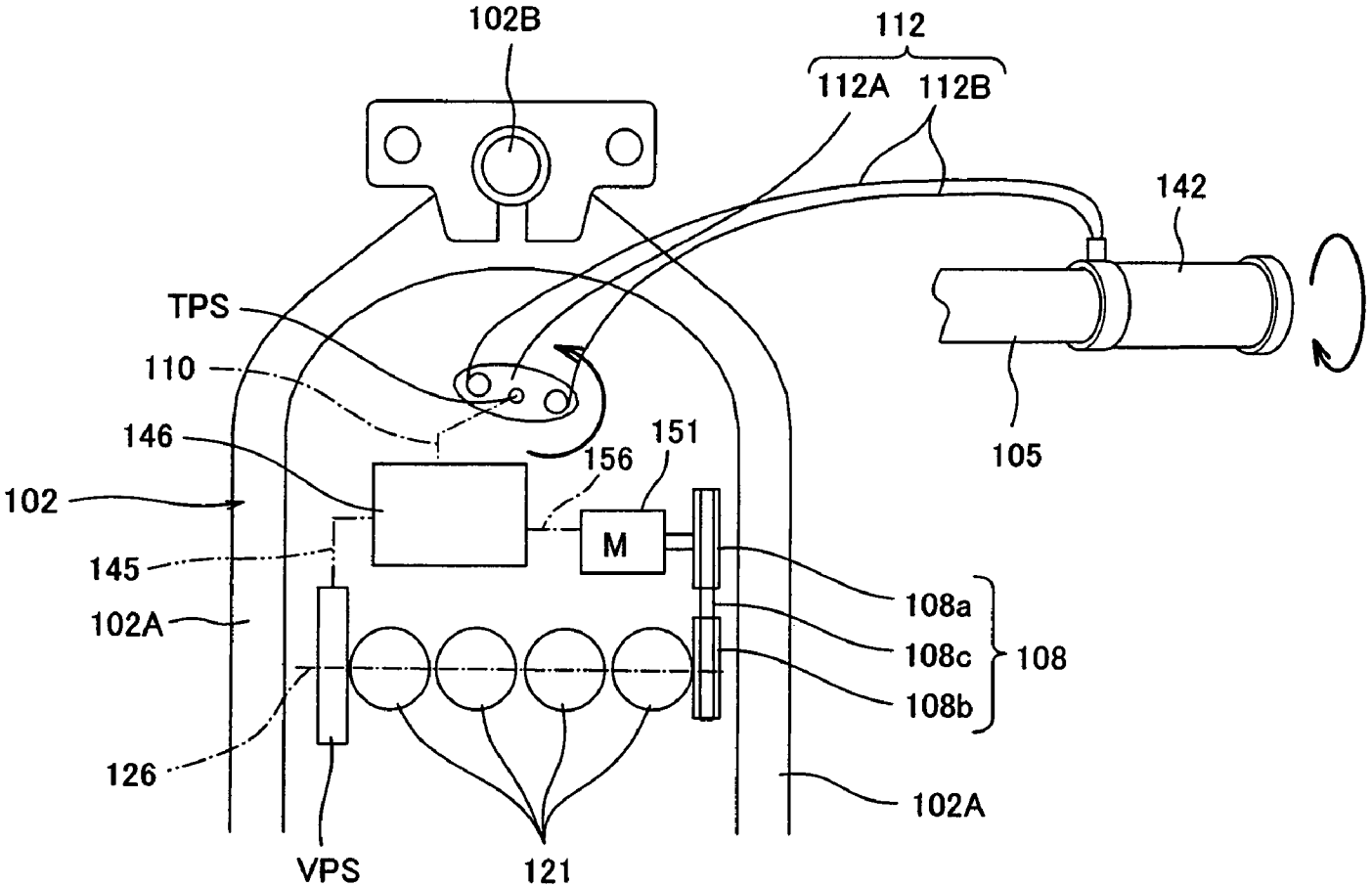
FIG. 13 is a schematic view illustrating a configuration of the multi-throttle valve control device according to a fourth embodiment of the present invention, and showing a similar view as seen from the same direction as that of FIG. 2.

Instead of the electrical dead band as described in the second and third embodiment, a dead band may be provided by a mechanical component as shown in FIG. 13. In FIG. 13, the throttle positioning sensor TPS is not provided to the twist grip throttle control 142. Instead, the twist grip throttle control 142 is connected to a pulley 112A in an ellipsoidal shape when viewed in a plan view through a pair of wires 112B. The pulley 112A is configured to be rotatable around a rotational shaft thereof according to the operation of the twist grip throttle control 142 by an action of the wires 112B. The pulley 112A and the wires 112B constitute a portion of an intermediate mechanism 112 that reproduces the rotational operation of the twist grip throttle control 142 at a remote location. The intermediate mechanism 112 may be constituted by other mechanical components such as gears, link mechanisms, and the like.

As shown in FIG. 13, the intermediate mechanism 112 is provided with the throttle positioning sensor TPS disposed on the rotational shaft of the pulley 112A. The throttle positioning sensor TPS is connected to the valve controller 146 by a signal line 110. The pulley 112A may be arranged in the vicinity of the throttle valves 121 and between the fuel tank (not shown) and the engine of the motorcycle as for a vertical position thereof.

The other configurations and functions are similar to the second and third embodiments and, thus, the same reference numerals are used to denote similar components to avoid unnecessary duplication and description thereof.

Figure 14:
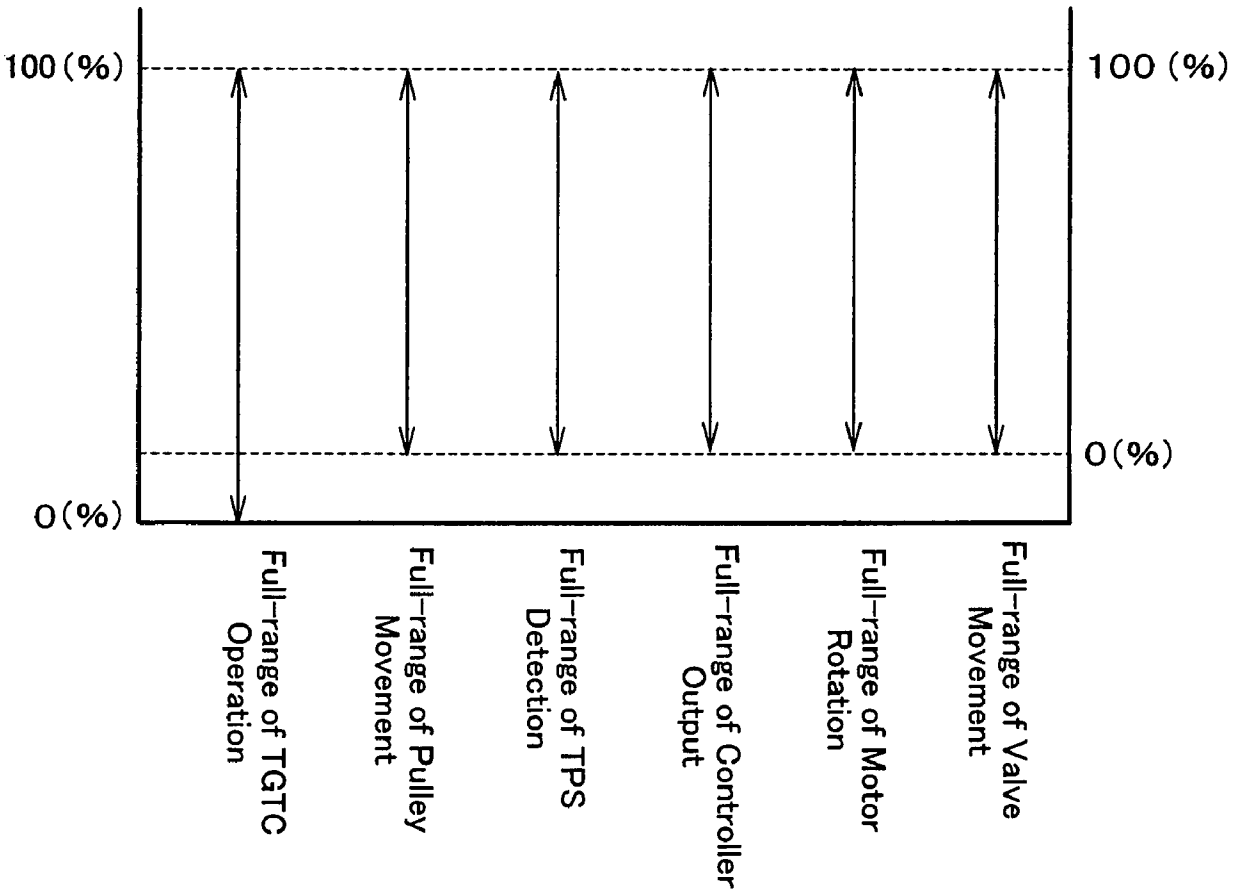
FIG. 14 is a graph illustrating a dead band provided to a pulley as an intermediate mechanism.

When the twist grip throttle control 142 is rotated in the arrow direction as shown in FIG. 13, the pulley 112A is rotated around the rotational shaft by action of the wires 112B. This rotation of the pulley 112A is detected by the throttle positioning sensor TPS. In this embodiment, the pulley 112A is provided with the dead band. More particularly, the pulley 112A is configured so that it does not rotate throughout a predetermined range from a zero position of the twist grip throttle control 142 (for example, approximately 2 degrees in the rotational angle of the twist grip throttle control 142). The zero position is 0% position on the left axis in FIG. 14, that is, the fully-closed position of the twist grip throttle control 142.

Thus, the predetermined range is the dead band, and in this dead band, the rotational movement of the pulley 112A is zero. Accordingly, the detection value of the throttle positioning sensor TPS transmitted to the valve controller 146 is also zero throughout the predetermined range from the zero position. On the other hand, when the twist grip throttle control is operated exceeding the predetermined range, the pulley 112A rotates according to the operational amount of the twist grip throttle control 142 and, thus, the throttle positioning sensor TPS transmits a detection value corresponding to the rotational angle thereof to the valve controller 146.

(Embodiment 5)

Figure 15:
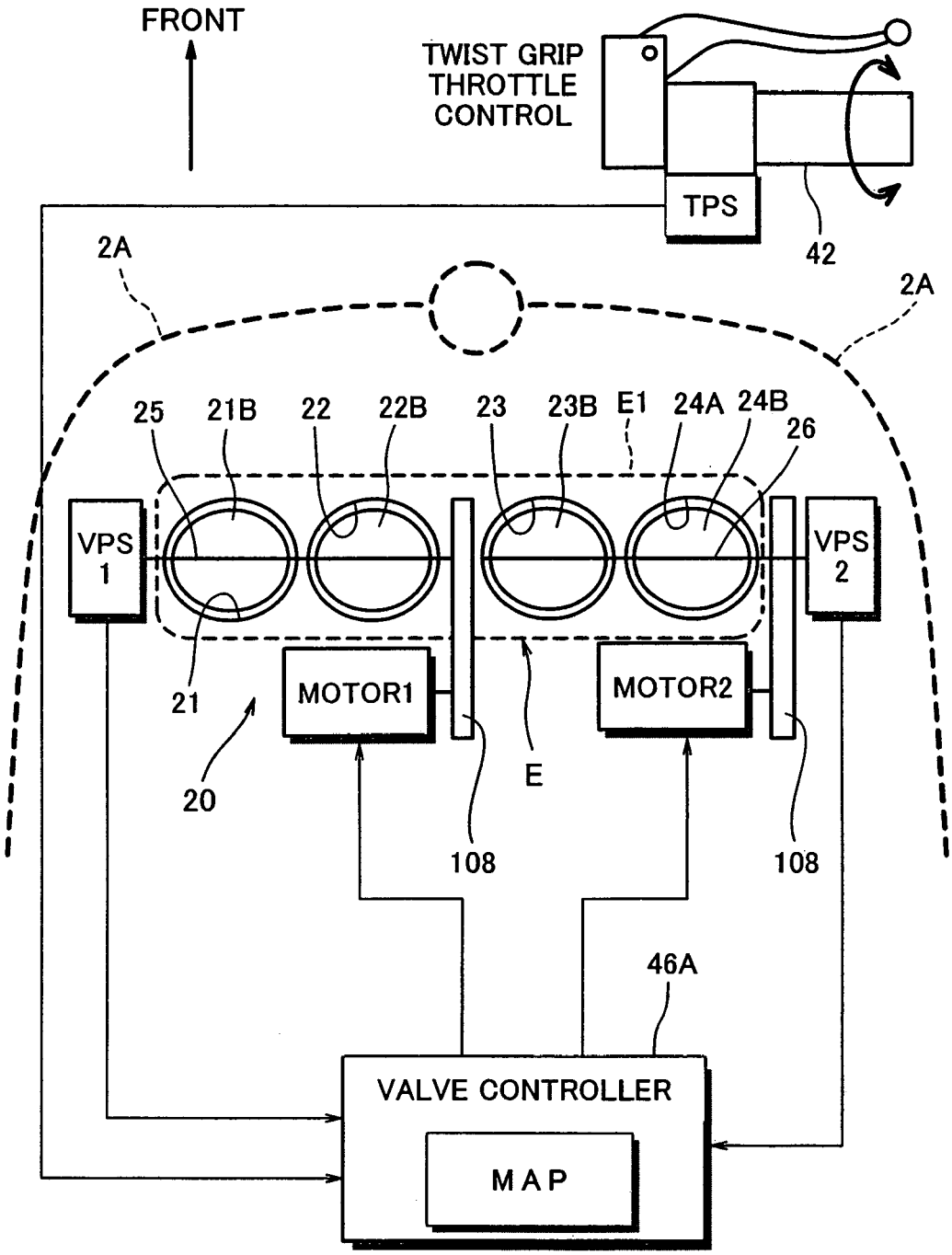
FIG. 15 is a view illustrating a configuration of the multi-throttle valve control device according to a fifth embodiment of the present invention.

FIG. 15 illustrates still another embodiment of the throttle valve control device. In FIG. 15, the engine E is a multi-cylinder engine (typically, a four-cylinder four-cycle engine) mounted on a motorcycle as one example of a leisure vehicle. The engine E is an in-line engine in which the cylinders are aligned along the width direction of the motorcycle. The engine E is equipped with a multi-throttle valve 20 including a plurality of throttle-valve sets. In this embodiment, the multi-throttle valve 20 is provided with two throttle-valve sets. Each of the throttle-valve sets may include one or more throttle valves.

As shown in FIG. 15, in this embodiment, a first throttle valve 21B and a second throttle valve 22B, which constitute a first throttle-valve set, are provided in a first air-intake pipe 21 and a second air-intake pipe 22, respectively. The first throttle-valve set is arranged on the left side of the motorcycle. Similarly, a third throttle valve 23B and a fourth throttle valve 24B, which constitute a second throttle-valve set, are provided in a third air-intake pipe 23 and an fourth air-intake pipe 24, respectively. The second throttle-valve set is arranged on the right side of the motorcycle.

A valve shaft 25 of the first throttle-valve set and a valve shaft 26 of the second throttle-valve set are arranged coaxially but provided separately so that they can operate independently of each other. In this embodiment, both the first throttle-valve set and the second throttle-valve set constitute respective "motor-driven throttle-valve sets."

Specifically, an output shaft of an electric motor MOTOR1 arranged parallel to the common valve shaft 25 is coupled to the first throttle-valve set through a power transmission mechanism 108. Similarly, an output shaft of an electric motor MOTOR2 arranged parallel to the common valve shaft 26 is coupled to the second throttle-valve set through the power transmission mechanism 108. The power transmission mechanisms 108 may be any power transmission mechanism such as a belt-pulley mechanism, arm-link mechanism, and gear mechanism as described in the other embodiments.

A valve positioning sensor VPS1 is coupled to a left end portion of the valve shaft 25 of the first throttle-valve set, and a valve positioning sensor VPS2 is coupled to a right end portion of the valve shaft 26 of the second throttle-valve set. The valve positioning sensors are connected to a valve controller 46A.

A twist grip throttle control (TGTC) 42, which is one example of the throttle operating portion, is provided with a throttle positioning sensor TPS that detects a amount of throttle work or an amount of throttle operation of the twist grip throttle control 42 and is connected to the valve controller 46A.

The valve controller 46A includes a map (hereafter "MAP"). The MAP typically contains the Valve Control Map (VCM) as in the first embodiment. The MAP may further contain the Fuel Injection Map (FIM), the Ignition Map (IGM), and the like. In this embodiment, the valve controller 46A includes a plurality of map sets. Although not shown in the figure, in this embodiment, the valve controller 46A may be connected to the crank positioning sensor, the battery, the headlight, the taillight, and so forth, as the ECU shown in FIG. 2.

The valve controller 46A refers to a first set of the MAP based on a signal indicating the amount of throttle work (i.e., the throttle operational amount), which is transmitted from the throttle positioning sensor TPS in response to the operation of the twist grip throttle control 42 by the operator. Then, the valve controller 46A determines an electric power to be supplied to the MOTOR1 according to the amount of throttle work, as described in the second embodiment, and applies the electric power to the MOTOR1. As previously described, the MAP typically stores electric power values proportional to amount of throttle works.

When the electric power is applied to the MOTOR1 by the valve controller 46A, the valve shaft 25 is driven through the left-side power transmission mechanism 108, whereby the throttle opening of the first throttle-valve set is adjusted. Consequently, the valve positioning sensor VPS1 coupled to the left end portion of the valve shaft 25 detects an actual throttle opening of the first throttle-valve set and transmits it to the valve controller 46A.

Next, the valve controller 46A refers to a second set of the MAP based on a signal indicating the throttle opening of the first throttle-valve set, which is transmitted from the valve positioning sensor VPS1. Then, the valve controller 46A determines an electric power to be supplied to the MOTOR2 according to the throttle opening of the first throttle-valve set, and applies the electric power to the MOTOR2. The second set of the MAP typically stores electric power values proportional to the throttle openings of the first throttle-valve set.

When the electric power is applied to the MOTOR2 by the valve controller 46A, the valve shaft 26 is driven through the right-side power transmission mechanism 108, whereby the throttle opening of the second throttle-valve set is adjusted. Consequently, the valve positioning sensor VPS2 coupled to the right end portion of the valve shaft 26 detects an actual throttle opening of the second throttle-valve set and transmits it to the valve controller 46A.

The other configurations and functions are similar to the first embodiment and, thus, the same reference numerals are used to denote similar components to avoid unnecessary duplication and description thereof.

The dead band as described in the second and third embodiments may be provided in such components as the throttle positioning sensor TPS, the valve controller 46, etc.

As this invention may be embodied in several forms without departing from the spirit of essential characteristics thereof, this embodiments are therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

The invention claimed is:

1. A multi-cylinder engine for driving a vehicle, comprising:

a plurality of cylinders; and a multi-throttle valve device including a plurality of air-intake passages, each of which being configured to lead air to the respective cylinder, and a plurality of throttle valves, each of which being provided in a different air-intake passage, and being configured to open and close the respective air-intake passage;

wherein at least one of the throttle valves is configured to be opened and closed independently of at least one of the other throttle valves, and wherein the at least one of the throttle valves is a cable-driven throttle valve which is cooperably coupled with a twist grip throttle control through a cable, and the at least one of the other throttle valves is a motor-driven throttle valve which is configured to be driven by a motor based on a control signal being given;

wherein the twist grip throttle control is configured to be operable by an operator to change the at least one of the throttle valves; and wherein the motor-driven throttle valve is configured so that a throttle opening thereof is controlled to follow a throttle opening of the cable-driven throttle valve with a predetermined time delay.

2. The multi-cylinder engine of claim 1, wherein the motor is arranged so that an output shaft thereof is parallel to a valve shaft which rotatably supports the motor-driven throttle valve and arranged parallel to a width direction of the engine so as to be across the respective air-intake passage, the width direction of the engine is a direction in which the plurality of the cylinders are arranged, and wherein the output shaft and the valve shaft are cooperably coupled through a power transmitting mechanism.

3. The multi-cylinder engine of claim 1, wherein the multi-cylinder engine is of four or more cylinders, the cable-driven throttle valve is one of a plurality of cable-driven throttle valves that are respectively provided to two or more cylinders among the four or more cylinders;

wherein each cylinder provided with one of the cable-driven throttle valves is configured to perform combustion successively with respect to an adjacent cylinder; and wherein the two or more of the cable-driven throttle valves are provided to cylinders which are adjacently arranged.

4. The multi-cylinder engine of claim 1, wherein the multi-throttle valve device includes a first throttle valve positioning sensor configured to detect a rotational position of the cable-driven throttle valve, and wherein the control signal for the motor-driven throttle valve corresponds to a detection value of the first throttle valve positioning sensor.

5. The multi-cylinder engine of claim 4, wherein the multi-throttle valve device further includes a second throttle valve positioning sensor configured to detect a rotational position of the motor-driven throttle valve for a reference to a target rotational position for the motor-driven throttle valve.

6. A leisure vehicle, comprising a multi-cylinder engine for driving the vehicle, the multi-cylinder engine includes:

a plurality of cylinders;

a multi-throttle valve device including a plurality of air-intake passages, each of which being configured to lead air to a respective cylinder of the plurality of cylinders, and a plurality of throttle valves, each of which being provided in a different air-intake passage, and being configured to open and close a respective air-intake passage of the plurality of air-intake passages, wherein at least one of the throttle valves is configured to be opened and closed independently of at least one of the other throttle valves; and a twist grip throttle control configured to be operable by a rider to change the at least one of the throttle valves;

wherein the at least one of the throttle valves is a cable-driven throttle valve configured to be mechanically interlocked with the twist grip throttle control through a cable, and the at least one of the other throttle valves is a motor-driven throttle valve which is configured to be driven by a motor based on a control signal being given.

7. The leisure vehicle of claim 6, wherein the leisure vehicle is a motorcycle including a battery, and wherein the motor-driven throttle valve is configured to be driven by a motor which operates by electric power supply from the battery.

8. The leisure vehicle of claim 6, further comprising:

a throttle positioning sensor configured to detect an amount of operation of the twist grip throttle control;

wherein the throttle positioning sensor is provided with a dead band having a predetermined range from a zero detection position thereof, and is configured to output a zero value as a detection value within the dead band even when the twist grip throttle control is operated to open the cable-driven throttle valve; and wherein the motor-driven throttle valve is configured so as not to be driven when a detection value of the throttle positioning sensor is within the dead band.

9. The throttle valve control device of claim 6, wherein the motor-driven throttle-valve set is configured so that a throttle opening thereof is controlled to follow a throttle opening of the cable-driven throttle-valve set with a predetermined time delay.

10. The throttle valve control device of claim 9, further comprising a second throttle valve positioning sensor configured to detect a rotational position of the motor-driven throttle-valve set.

11. The throttle valve control device of claim 9, wherein the cable-driven throttle-valve set is provided to the cylinders which are adjacently arranged.

12. A throttle valve control device, comprising:

a first throttle-valve set provided in air-intake passage(s), and configured to open and close the air-intake passage (s) to one or more cylinders of a multi-cylinder engine;

a second throttle-valve set provided in different air intake passage(s), and configured to open and close the different air-intake passage(s) to other one or more cylinders of the multi-cylinder engine;

a first throttle valve positioning sensor configured to detect a throttle opening of the first throttle-valve set; and a valve controller configured to adjust the throttle opening of the first throttle-valve set according to an amount of throttle work by an operator, and to adjust the throttle opening of the second throttle-valve set based on the throttle opening of the first throttle-valve set detected by the first throttle valve positioning sensor.

13. The throttle valve control device of claim 12, wherein the multi-cylinder engine is of four or more cylinders, and the first throttle-valve set includes a plurality of throttle valves in the cylinders, each cylinder being configured to perform combustion successively with respect to an adjacent cylinder.

14. The throttle valve control device of claim 12, wherein at least one of the first and second throttle-valve sets is configured so that the plurality of throttle valves within the throttle-valve set are coupled together with a common valve shaft;

wherein the common valve shaft of at least one of the first and second throttle-valve sets is coupled with an output shaft of a motor through a power transmitting mechanism so that the throttle-valve set is driven by the motor through the power transmitting mechanism, and the valve shaft and the output shaft are configured to be parallel with each other; and wherein the valve controller is configured to adjust the throttle opening by controlling a rotation of the motor.

15. The throttle valve control device of claim 14, wherein the power transmitting mechanism is a belt-pulley mechanism.

16. The throttle valve control device of claim 12, further comprising:

a twist grip throttle control configured to be operable by the operator to change the at least one of the first and second throttle-valve sets; and a throttle positioning sensor configured to detect the amount of throttle work by detecting an amount of operation of the twist grip throttle control;

wherein the valve controller is configured to not adjust the throttle opening of the first throttle-valve set within a dead band corresponding to a predetermined range from a substantially zero detection position of the amount of throttle work which is detected by the throttle positioning sensor, even when the twist grip throttle control is operated to open the at least one of the first and second throttle-valve sets.

17. The throttle valve control device of claim 12, further comprising a twist grip throttle control configured to be operable by the operator to change the at least one of the first and second throttle-valve sets, wherein the throttle positioning sensor is attached to the twist grip throttle control, and configured to detect an amount of operation of the twist grip throttle control; and a throttle positioning sensor configured to detect the amount of throttle work by the operator;

wherein the throttle valve control device is configured to not adjust the throttle opening of the second throttle-valve set even when the amount of operation of the twist grip throttle control detected by the throttle positioning sensor is a substantially non-zero value within a predetermined range.

18. The throttle valve control device of claim 17, wherein the throttle positioning sensor is configured so as to output a substantially zero detection value within the predetermined range.

19. The throttle valve control device of claim 17, further comprising an actuator configured to drive the second throttle-valve set so that the throttle opening of the second throttle-valve set is adjusted based on a control value from the valve controller;

wherein the valve controller is configured to not drive the actuator when the amount of throttle work detected by the throttle positioning sensor is within the predetermined range.

* * * * *